US010738457B1

(12) United States Patent
Hendry

(10) Patent No.: US 10,738,457 B1
(45) Date of Patent: Aug. 11, 2020

(54) SCREEN SUPPORT ASSEMBLY WITH WIDE LATERAL SUPPORT EFFICIENCY

(71) Applicant: Thomas G. Hendry, Lehigh Acres, FL (US)

(72) Inventor: Thomas G. Hendry, Lehigh Acres, FL (US)

( * ) Notice: Subject to any disclaimer, the term of this patent is extended or adjusted under 35 U.S.C. 154(b) by 0 days.

(21) Appl. No.: 16/435,592

(22) Filed: Jun. 10, 2019

Related U.S. Application Data

(63) Continuation-in-part of application No. 15/916,300, filed on Mar. 9, 2018, now Pat. No. 10,316,508,
(Continued)

(51) Int. Cl.

| | |
|---|---|
| ***E04B 1/19*** | (2006.01) |
| ***E04B 1/24*** | (2006.01) |
| ***E04B 1/41*** | (2006.01) |
| ***E04H 12/22*** | (2006.01) |
| ***E06B 9/52*** | (2006.01) |

(Continued)

(52) U.S. Cl.
CPC ..... *E04B 1/2403* (2013.01); *E04B 1/1903* (2013.01); *E04B 1/40* (2013.01); *E04B 1/585* (2013.01); *E04B 1/5831* (2013.01); *E04H 15/34* (2013.01); *E06B 9/52* (2013.01); *E04B 2001/2415* (2013.01);
(Continued)

(58) Field of Classification Search
CPC ..... E04B 2001/246; E04B 2001/2415; E04B 2001/2406; E04B 2001/405; E04B 2001/2457; E04B 2001/2451; E04B 2001/2421; E04B 2001/5856; E04B 1/2403; E04B 1/1903; E04B 1/585; E04B 1/5831; E04B 1/40; E04H 15/34
USPC ..... 52/653.2, 655.1, 848, 849; 135/120.3, 135/909; 403/170, 171, 205, 292, 294, 403/295, 298
See application file for complete search history.

(56) References Cited

U.S. PATENT DOCUMENTS

| | | | |
|---|---|---|---|
| 742,549 | A | 10/1903 | Zed et al. |
| 1,430,809 | A | 10/1922 | Ilseng |

(Continued)

FOREIGN PATENT DOCUMENTS

| | | | |
|---|---|---|---|
| CH | 452154 | | 5/1968 |
| CN | 204983145 U | * | 1/2016 |

(Continued)

OTHER PUBLICATIONS 2 page machine translation of CN 204983145 U, Jan. 2016. (Year: 2016).*

(Continued)

*Primary Examiner* — Robert Canfield
(74) *Attorney, Agent, or Firm* — Hanrahan Law Firm, P.A.; Benjamin M. Hanrahan

(57) ABSTRACT

A support assembly for providing a high degree of lateral strength and integrity is presented herein. The support assembly includes a beam support bracket having a body and at least one elongated support member that is slidingly engaged with a corresponding lateral beam. The elongated support member of the beam support bracket is defined by spaced apart first and second support plates each including oppositely disposed edges which will mate with corresponding ledges, protrusions or reinforced corners within the lateral beam and bracket body.

18 Claims, 33 Drawing Sheets

Related U.S. Application Data which is a continuation-in-part of application No. 29/637,977, filed on Feb. 23, 2018, now Pat. No. Des. 879,326, and a continuation-in-part of application No. 29/637,972, filed on Feb. 23, 2018, and a continuation-in-part of application No. 29/637,975, filed on Feb. 23, 2018, now Pat. No. Des. 856,781, and a continuation-in-part of application No. 15/470,893, filed on Mar. 27, 2017, now Pat. No. 10,066,384, which is a continuation of application No. 15/211,898, filed on Jul. 15, 2016, now Pat. No. 9,605,425, which is a continuation-in-part of application No. 14/660,673, filed on Mar. 17, 2015, now Pat. No. 9,422,711.

(51) Int. Cl.
*E04H 15/34* (2006.01)
*E04B 1/58* (2006.01)
*E04B 1/38* (2006.01)

(52) U.S. Cl.
CPC ..... *E04B 2001/2421* (2013.01); *E04B 2001/2451* (2013.01); *E04B 2001/405* (2013.01)

(56) References Cited

U.S. PATENT DOCUMENTS 1,788,096 A * 1/1931 Friedemann ..... A47F 5/04 108/96
2,101,349 A 12/1937 Sharp
2,632,535 A 3/1953 Clerk
2,776,735 A 1/1957 Bancroft
2,918,153 A 12/1959 Hammitt et al.
3,119,635 A * 1/1964 Dealy ..... E02D 5/523 403/334
3,222,841 A 12/1965 Lipof
3,246,433 A 4/1966 Eriksson
3,255,769 A 6/1966 Lloyd
3,304,108 A * 2/1967 Hamilton ..... F16L 41/025 403/295
3,354,891 A 11/1967 Brown
3,386,590 A 6/1968 Gretz
3,532,369 A 10/1970 Reilly
3,561,801 A 2/1971 Chiu
3,620,558 A 11/1971 Macmillan
3,645,569 A 2/1972 Reilly
3,656,515 A 4/1972 Wogerbauer et al.
3,666,298 A 5/1972 Reilly
3,726,551 A * 4/1973 Levenberg ..... A47B 47/00 403/172
3,786,612 A 1/1974 Baker
3,831,336 A * 8/1974 Diemer ..... A47B 47/0008 52/653.2
3,867,045 A 2/1975 Beals
3,922,101 A 11/1975 Salmon et al.
3,955,702 A 5/1976 Lundy
4,076,432 A 2/1978 Glaser
4,159,758 A 7/1979 Courson
4,315,386 A 2/1982 Clarke
4,323,319 A * 4/1982 Adams ..... A47B 47/0008 403/171
4,516,376 A * 5/1985 King ..... A47B 47/0008 403/171
4,570,406 A 2/1986 DiFazio
4,570,408 A 2/1986 Frascaroli et al.
4,718,184 A 1/1988 Sherman
4,718,213 A 1/1988 Butterfield
4,785,591 A 11/1988 Dahlen
4,831,804 A 5/1989 Sayer
4,841,688 A * 6/1989 Rinaldi ..... E04H 15/322 52/63
4,960,343 A 10/1990 Reilly
5,079,860 A 1/1992 Nugent
5,144,780 A 9/1992 Gieling et al.
5,156,484 A 10/1992 Allen
5,203,135 A * 4/1993 Bastian ..... F16B 7/0413 403/292
5,383,723 A 1/1995 Meyer
5,451,115 A * 9/1995 Sayres ..... A47B 47/0008 403/171
5,485,705 A 1/1996 Guillemet
5,556,218 A 9/1996 Homer
D376,855 S 12/1996 Leung
5,605,410 A 2/1997 Pantev
D387,655 S * 12/1997 Kopish ..... D8/382
5,864,997 A 2/1999 Kelly
5,904,437 A 5/1999 Allen
5,997,117 A * 12/1999 Krietzman ..... H02B 1/301 312/265.4
6,062,761 A 5/2000 Allen
6,067,760 A 5/2000 Nowell
6,279,288 B1 8/2001 Keil
6,279,289 B1 8/2001 Soder et al.
6,338,226 B1 1/2002 Gauthier et al.
6,339,891 B1 1/2002 Cox
D454,962 S 3/2002 Grace
6,601,362 B1 8/2003 Prince
6,668,495 B1 12/2003 Prince
6,755,004 B1 6/2004 Power, Jr. et al.
6,826,885 B2 12/2004 Raskin et al.
7,004,667 B2 2/2006 Ludwig et al.
7,080,492 B1 7/2006 Guiller
7,155,874 B2 1/2007 Lee
7,223,044 B2 5/2007 Quintile
7,568,323 B2 8/2009 Shelton et al.
D600,831 S 9/2009 Munakata et al.
D603,065 S 10/2009 Hamilton et al.
7,628,563 B2 * 12/2009 Winkler ..... A47B 43/003 403/387
7,677,003 B2 * 3/2010 Baughn ..... E06B 3/9682 52/473
D616,114 S 5/2010 Harder
7,739,841 B1 6/2010 Puckett
7,832,180 B2 * 11/2010 Dolby ..... E04B 2/96 52/235
8,028,494 B2 * 10/2011 Denn ..... E04B 1/18 52/289
8,151,533 B2 4/2012 Krieger
D666,743 S 9/2012 Teffenhart, Jr.
8,585,313 B2 11/2013 Wojøtowicz et al.
8,672,280 B2 3/2014 Suciu et al.
8,726,583 B2 * 5/2014 Verdecia ..... E04B 1/24 52/126.1
8,756,900 B1 6/2014 Hudson et al.
D733,645 S 7/2015 Cai et al.
9,091,119 B2 7/2015 Kim
D739,960 S 9/2015 Britton
9,422,711 B1 8/2016 Hendry
D775,741 S 1/2017 Kashiwagi et al.
9,605,425 B1 3/2017 Hendry
D783,390 S 4/2017 Nelson
D784,060 S 4/2017 Davidsen
D787,094 S 5/2017 Britton
D790,730 S 6/2017 Perez
D815,758 S 4/2018 Hendry
D818,293 S 5/2018 Müller
D823,666 S 7/2018 MacDonald et al.
D823,667 S 7/2018 MacDonald et al.
D823,668 S 7/2018 MacDonald et al.
D823,669 S 7/2018 MacDonald et al.
D823,670 S 7/2018 MacDonald et al.
D826,692 S 8/2018 MacDonald et al.
D827,414 S 9/2018 MacDonald et al.
D827,416 S 9/2018 MacDonald et al.
10,066,384 B1 9/2018 Hendry
D830,545 S 10/2018 Loughren et al.
D834,396 S 11/2018 MacDonald et al.
D834,920 S 12/2018 MacDonald et al.
D835,301 S 12/2018 Lee
D839,075 S 1/2019 MacDonald et al.

(56) References Cited

U.S. PATENT DOCUMENTS

| | | | | |
|---|---|---|---|---|
| 10,316,508 | B1 | 6/2019 | Hendry | |
| D854,710 | S | 7/2019 | Hendry | |
| D856,781 | S | 8/2019 | Hendry | |
| D879,326 | S | 3/2020 | Hendry | |
| 2004/0035082 | A1 | 2/2004 | Hudoba et al. | |
| 2005/0193680 | A1* | 9/2005 | Wang | E06B 3/9688 52/656.9 |
| 2006/0115324 | A1* | 6/2006 | Zenda | F16B 7/18 403/292 |
| 2007/0074480 | A1 | 4/2007 | Kleila et al. | |
| 2007/0130786 | A1 | 6/2007 | Wu | |
| 2007/0180786 | A1 | 8/2007 | Sotuyo | |
| 2007/0266671 | A1 | 11/2007 | Chromy | |
| 2008/0016816 | A1 | 1/2008 | Kim | |
| 2008/0190068 | A1* | 8/2008 | Tapscott | E04B 1/2403 52/690 |
| 2013/0272777 | A1* | 10/2013 | Hayter | E06B 3/9645 403/205 |
| 2014/0250821 | A1 | 9/2014 | Strickland et al. | |
| 2014/0311076 | A1 | 10/2014 | Ishaque et al. | |
| 2015/0121788 | A1 | 5/2015 | Kim | |
| 2016/0138261 | A1 | 5/2016 | Zhang et al. | |
| 2017/0321446 | A1 | 11/2017 | Antinolfi | |
| 2018/0094418 | A1* | 4/2018 | Winter | E04B 1/2403 |
| 2018/0094426 | A1 | 4/2018 | Winter | |

FOREIGN PATENT DOCUMENTS

| | | | | |
|---|---|---|---|---|
| CN | 303693360 | A1 | 6/2016 | |
| DE | 4112181 | A1 | 10/1992 | |
| DE | 202014103897 | U1 * | 10/2014 | F16B 7/0446 |
| EP | 1134328 | A2 * | 9/2001 | E04B 2/965 |
| EP | 1916349 | A2 * | 4/2008 | E04B 1/2403 |
| EP | 2988007 | A1 | 2/2016 | |
| GB | 1009846 | A | 11/1965 | |
| WO | 9421867 | A1 | 9/1994 | |
| WO | 0066896 | A1 | 11/2000 | |
| WO | 2012016297 | A1 | 2/2012 | |

OTHER PUBLICATIONS

EZ Screen Room <https://www.homedepot.com/p/EZ-Screen-Room-8-ft-x-2-in-x-2-in-Aluminum-Whie-Extrusion-with-Spline-Track-EZSR8PW/202453633> Jun. 11, 2013 (Year: 2013).

Screened Wall Systrems <http://www.screen-house.com/screenroom_three_season_walls.htm> Jul. 18, 2017/ (Year: 2017).

* cited by examiner

SCREEN SUPPORT ASSEMBLY WITH WIDE LATERAL SUPPORT EFFICIENCY

CLAIM OF PRIORITY/CROSS REFERENCE TO RELATED APPLICATIONS

The present application is a continuation-in-part patent application of previously-filed, currently pending U.S. patent application Ser. No. 15/916,300 filed on Mar. 9, 2018.

U.S. patent application Ser. No. 15/916,300 is a continuation-in-part of U.S. patent application Ser. No. 29/637,977 filed on Feb. 23, 2018, and is a continuation-in-part of U.S. patent application Ser. No. 29/637,972 filed on Feb. 23, 2018, and is a continuation-in-part of U.S. patent application Ser. No. 29/637,975 filed on Feb. 23, 2018, and is a continuation-in-part of U.S. patent application Ser. No. 15,470,893 filed on Mar. 27, 2017 (now U.S. Pat. No. 10,066,384 issued on Sep. 4, 2018), which is a continuation of U.S. patent application Ser. No. 15/211,898 filed on Jul. 15, 2016 (now U.S. Pat. No. 9,605,425 issued on Mar. 28, 2018), which is a continuation-in-part of U.S. patent application Ser. No. 14/660,673 filed on Mar. 17, 2015 (now U.S. Pat. No. 9,422,711 issued on Aug. 23, 2016).

The contents of all of the above-referenced previously-filed patent applications (namely, Ser. Nos. 15/916,300, 29/637,972, 29/637,975, 29/637,977, 15/470,893, 15/211,898, and 14/660,673) are incorporated herein in their entirety by reference.

FIELD OF THE INVENTION

The present invention is generally directed to a support assembly, and in particular, a screen support assembly with a wide lateral support efficiency in that with the construction of the various embodiments of the present invention, horizontal or lateral beams may extend large distances from the vertical supports, allowing for large or wide open screen portions between vertical supports.

BACKGROUND OF THE INVENTION

Screen enclosures for patios, pool areas, porches, etc. are well known in the art and are installed on many homes, buildings, and apartments throughout the United States and the World. Such screen enclosures are often constructed by installing closely spaced vertical posts or beams with horizontal beams spanning between them. Screen material, often in square or rectangular panels, will then fill the open spaces between the vertical posts and horizontal beams.

The problem, however, is that the vertical posts, and sometimes the horizontal beams, may obstruct views and scenery for those individuals positioned within the enclosure and who wish to gaze or look out through the screen and beyond the enclosure. This is particularly true for many luxurious homes and buildings that overlook bodies of water, such as lakes, oceans, etc. or golf courses, pastures, mountains, etc. While the screened enclosure may be beneficial in protecting the enclosed area from many of the outside elements, wildlife, and insects, it also obstructs the once stunning view of the outside scenery.

Accordingly, there is a need in the art for a new screen enclosure or support assembly that includes a high degree of lateral strength and structural integrity between the joints where the vertical and horizontal or lateral beams meet. The high strength and integrity of the proposed screen enclosure and support assembly must support horizontal beams that can span great distances (e.g., greater than thirty feet) between vertical posts, thereby creating a wide open viewing panel that is not obstructed by intermediate vertical support posts.

SUMMARY OF THE INVENTION

Accordingly, the present invention is generally directed to a support assembly which includes a high degree of lateral strength and integrity in order to allow for lateral beams to span great distances between vertical supports. This provides wide open spaces or screened panels that create unobstructed or less obstructed views there through.

In particular, the support assembly of at least one embodiment includes a beam support bracket having at least one laterally disposed elongated portion that is slidingly or telescopically engaged with a corresponding lateral beam. For instance, the elongated portion of the beam support bracket is defined by spaced apart first and second extension members or support plates. In some embodiments the extension members or support plates may be connected to one another via internal support webbing or spacer plates, while in other embodiments, the support plates may be disconnected or otherwise independent of one another.

Further, the extension members or support plates each include oppositely disposed edges, such as, but not limited to, upper and lower edges, which will mate with corresponding ledges or protrusions disposed within the lateral beam, for example, at or near inside corners thereof.

Specifically, the lateral beam(s) may include rectangular-shaped tubes manufactured out of extruded aluminum or other materials capable of facilitating the implementation of the present invention. The beam(s) include an internal receiving portion with reinforced corners or surface protrusions which define channels through which the extension members or support plates of the beam support bracket are slidingly or telescopically engaged.

For instance, the elongated portion of the beam support bracket may be disposed within the internal receiving portion of the lateral beam such that the oppositely disposed edges of each of the extension members or support plates correspondingly mate with the reinforced corners on the inside of the lateral beam. The mating engagement between the bracket and the beam restrict side-to-side, up and down and rotational movement there between.

Further embodiments may also include a support post with an internal receiving portion similar to that of the lateral beam. Specifically, the support post may include reinforced corners on the inside thereof in order to define channels through which a downwardly directed portion of the support beam will fit or engage. Certain embodiments of the support post are constructed from an extruded aluminum, similar to the lateral beams, although other materials and methods of construction may be implemented.

The lateral beams and the support post may further include screen retention assemblies, such as spline grooves, within which a screen panel and retention spline may be inserted for attaching screen material thereto. Other screen retention assemblies may be implemented or incorporated within the full spirit and scope of the present invention.

Further, it should also be noted that the screen or support assembly of certain embodiments of the present invention may be constructed to withstand high velocity winds, including hurricane force winds. Thus, certain embodiments may be constructed to pass stringent wind velocity standards and tests that may be found or implemented in many parts of the United States, including Florida, and Worldwide.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
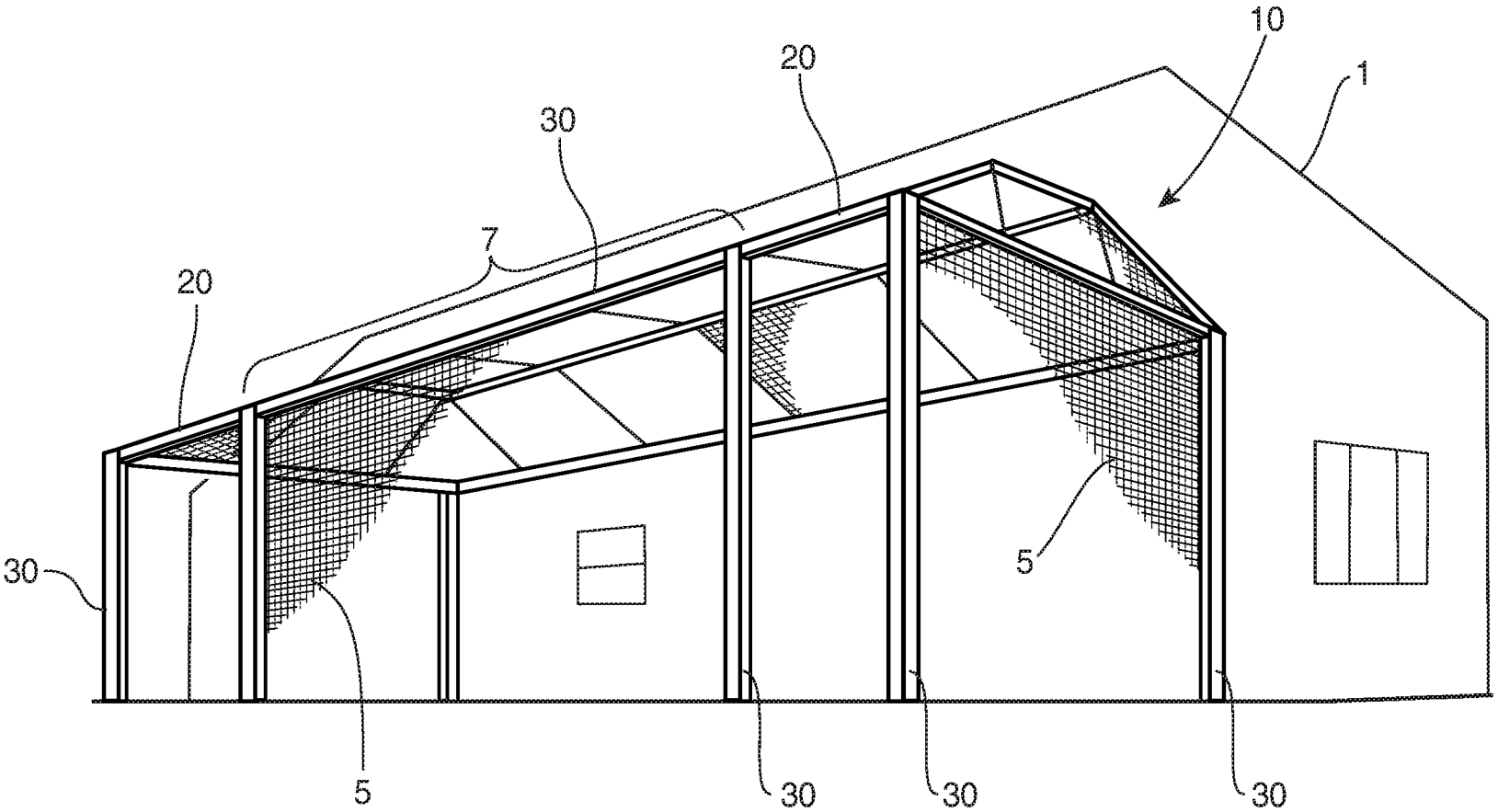
FIG. 1 is a perspective view of the support assembly of at least one embodiment of the present invention installed on home or other structure.

As shown in the accompanying drawings, and with particular reference to FIG. 1, the present invention is directed to a support assembly, as generally shown by reference character 10. Particularly, in the exemplary embodiment illustrated in FIG. 1, the support assembly 10 is structured to support one or more screen panels 5 as is shown installed on the rear portion of a structure 1, such as a home. The screened or other enclosure may enclose a pool, patio, or other area. However, while many implementations of the support assembly 10 of the present invention may be used to support or construct screen enclosures on homes, businesses or other structures 1, as generally illustrated in FIG. 1, for example, other embodiments may be used for other various support assembly applications.

In any event, as provided herein, the support assembly 10 of the various embodiments of the present invention provides significant lateral or horizontal strength and integrity allowing for the construction of or implementation of wide open screen panels or other areas, for example, as generally represented by reference character 7 in FIG. 1. Particularly, the large or wide open screen panels may be configured such that vertical support members 30, which at least partially support the horizontal or lateral beams 20, may be positioned great distances from one another, including, for example, up to approximately thirty-five (35) feet or more. Such a configuration, made possible by the lateral strength and integrity between the horizontal or lateral beams 20 and the vertical support posts 20, creates large, wide and quite visually stunning, viewing panels unobstructed by vertical support posts 30.

Figure 2A:
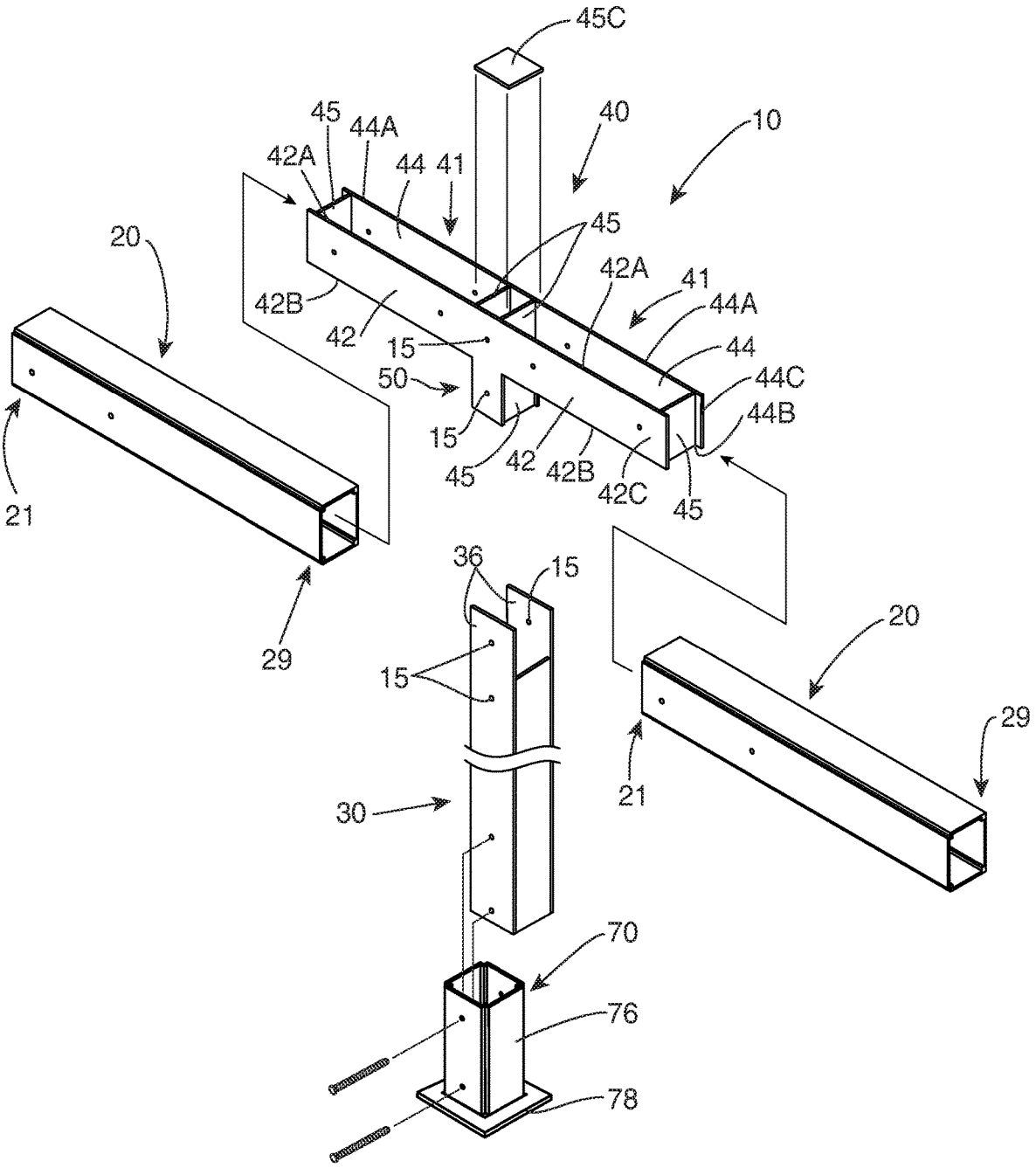
FIG. 2A is an exploded view of the support assembly as disclosed in accordance with at least one embodiment of the present invention.
Figure 2B:
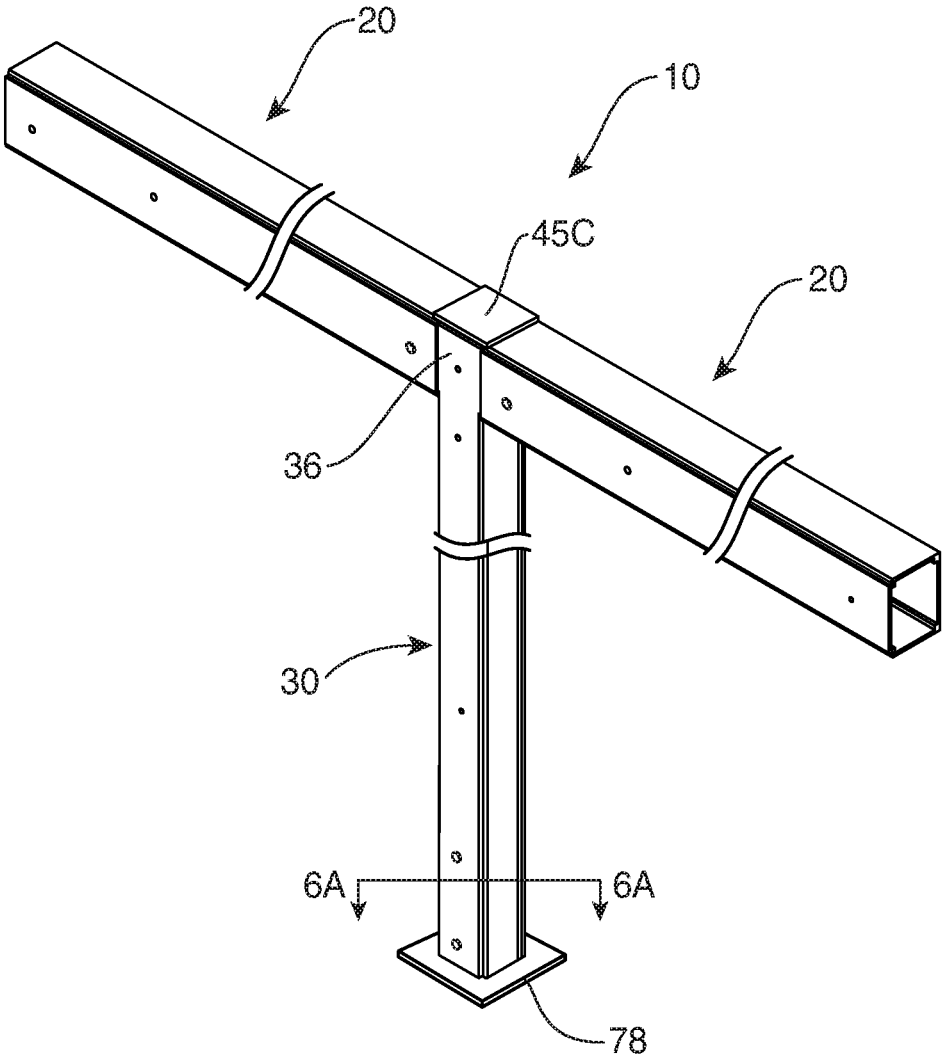
FIG. 2B is a perspective view of the support assembly illustrated in FIG. 2A.

For instance, referring now to FIGS. 2A and 2B, the support assembly 10 includes a beam support bracket 40, at least one lateral beam 20, and a substantially vertically oriented support post 30. As described herein, the lateral beam(s) 20 are slidingly engaged with or otherwise over elongated portions 41 of the beam support bracket 40. It should be noted, however, that a reverse configuration may be implemented wherein the beam support bracket 40 is configured to slide over the lateral beam(s) 20. Similarly, a downward portion 50 of the beam support bracket 40 is slidingly engaged within an end of the support post 30, such as an upper end, although, again, a reverse embodiment may be implemented wherein the support post slides within the downward portion 50.

It should also be noted that while FIGS. 2A and 2B illustrate a "T" shaped beam support bracket, other shapes may be contemplated within the full spirit and scope of the present invention in order to install or construct a support assembly 10, for example, as shown in FIG. 1. For instance, the beam support assembly 40 may comprise a corner or "L" shape, or other configurations which may facilitate support angles, etc. Accordingly, a single beam support bracket 40 may support or engage with one, two or more lateral beams 20.

Still referring to FIG. 2A, the beam support bracket 40 of at least one embodiment of the present invention includes laterally spaced first and second extension members or support plates 42, 44 which define the elongated portion(s) 41 that is/are slidingly engaged or disposed within a corresponding lateral beam 20. Each of the extension members or support plates 42, 44 include oppositely disposed edges, such as, but not limited to, upper edges 42A, 44A and lower edges 42B, 44B that will correspondingly mate with cooperatively constructed and disposed portions within the lateral beam(s) 20, as described herein.

Further, in at least one exemplary embodiment of the present invention, the beam support bracket 40 is constructed by securing a plurality of spacer plates 45 between the two laterally spaced extension members 42, 44 in order to space the extension members 42, 44 a proper distance from one another to correspondingly and slidingly fit within the lateral beam 20. Accordingly, the extension members 42, 44 may comprise separately structured metal, aluminum or other like plates laterally spaced from one another via at least one, but more practically, a plurality of spacer plates 45. For instance, in the "T" shaped construction illustrated in FIG. 2A, the beam support bracket 40 may comprise two (2) "T" shaped support plates 42, 44 laterally spaced from one another and interconnected to one another via one or more spacers 45. The "T" shape creates two elongated portions 41 extending from the downward portion 50, although, as noted above, other shapes and brackets can be implemented. The spacer plates 45 may thus be welded, screwed, glued, adhered, or otherwise connected to the inside surface of the plates or extension members or support plates 42, 44. Other ways of manufacturing or constructing the beam support bracket 40 may be contemplated within the full spirit and scope of the various embodiments disclosed herein.

Figure 3A:
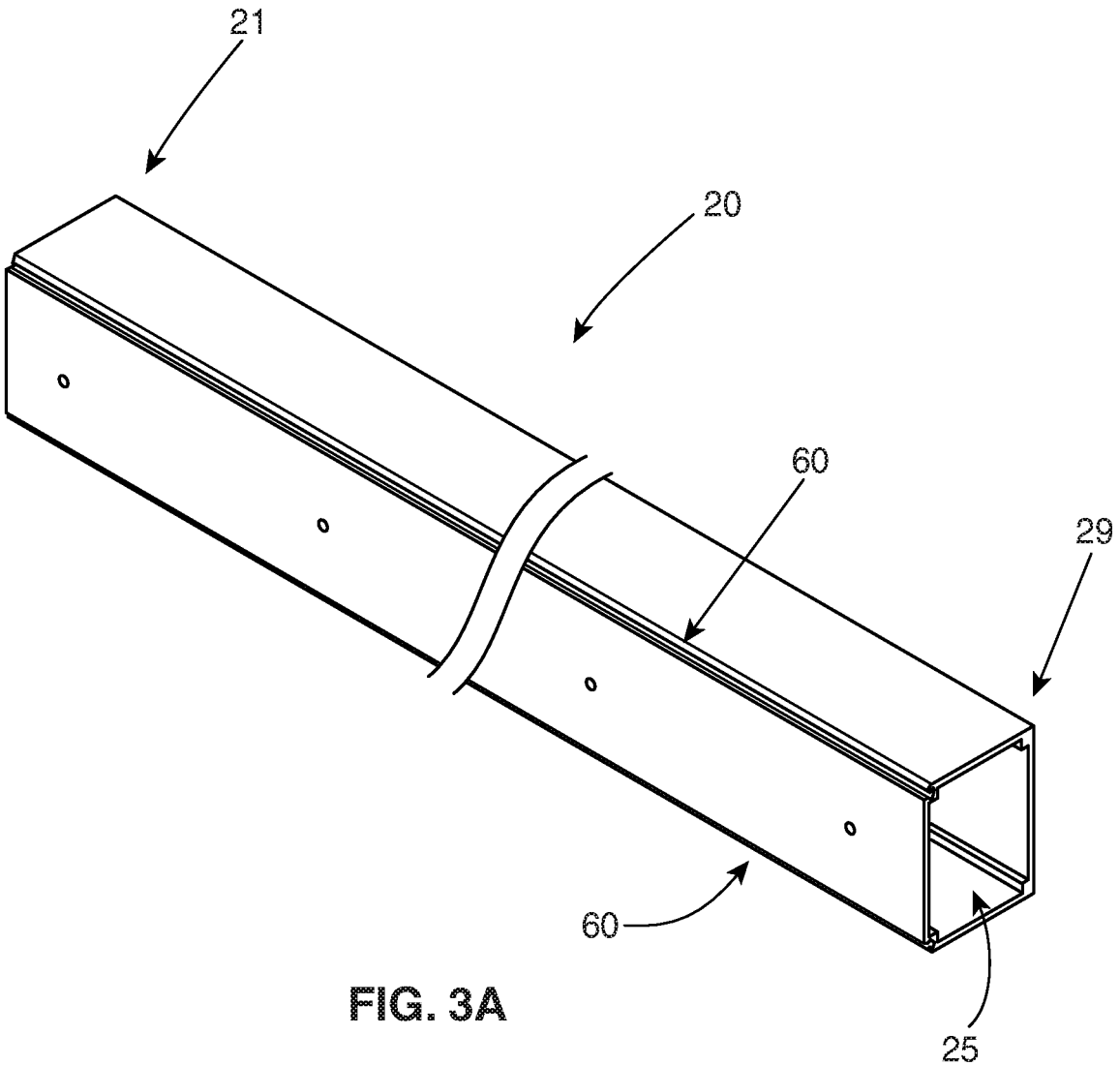
FIG. 3A is a perspective view of a lateral beam as disclosed in accordance with at least one embodiment of the present invention.
Figure 3B:
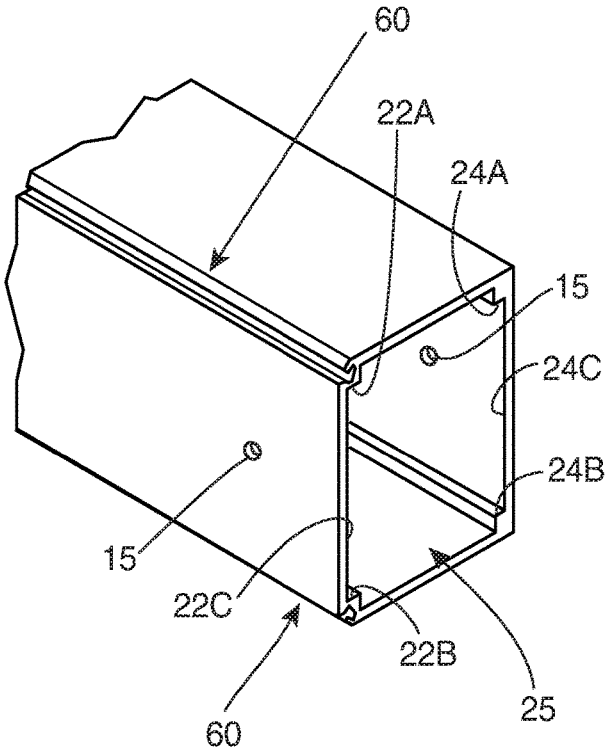
FIG. 3B is a partial perspective end view of the lateral beam illustrated in FIG. 3A.

Referring now to FIGS. 3A and 3B, an exemplary embodiment of the lateral beam 20 is shown. For instance, the lateral beam 20 may be connected to a support bracket 40 on each end 21, 29. Due to the significant strength and integrity of the interconnections between the lateral beam 20 and the support brackets 40, the lateral beam 20 may, in some instances, span a distance of approximately thirty-five (35) feet or more between the support brackets 40 or vertical supports 20. Of course, other distances, whether longer or shorter may be implemented in order to construct the support assembly 10, for example, as shown in FIG. 1. Further, the lateral beams 20 and/or the support post 30 of the various embodiments disclosed herein may include one or more screen retention assemblies 60, such as retention channels configured to receive a portion of a screen panel and a corresponding spline member therein. Other screen retentions assemblies now known or later developed in the art are contemplated in order to secure a screen panel to the lateral beam 20.

Furthermore, the lateral beams 20 of the various embodiments of the present invention may be constructed by way of metal or aluminum extrusion techniques in that the lateral beam(s) 20 may be extruded pieces of aluminum or other metal. For example, in one illustrative embodiments, the lateral beams 20 may comprise 60-63 T6 extruded aluminum, although other materials may be implemented in order to facilitate the practice of the present invention in the intended manner. In addition, the lateral beam(s) 20 of at least one exemplary embodiment may comprise a rectangular tube comprising a width of six (6) inches, a height of eight (8) inches and a thickness of 0.19 inches. Other dimensions and configuration may be implemented within the scope of the present invention.

Still referring to FIGS. 3A and 3B, the lateral beam 20 includes an internal receiving portion 25 with first and second surface protrusion pairs or reinforced corner portions, wherein the first surface protrusion pair may be defined by a first upper surface protrusion 22A and a first lower surface protrusion 22B, and the second surface protrusion pair defined by a second upper surface protrusion 24A and a second lower surface protrusion 24B. For instance, the surface protrusions 22A, 22B, 24A, 24B of the various embodiments comprise cooperatively structured surfaces or ledges that will correspondingly mate or fit with the upper and lower edges 42A, 42B, 44A, 44B of the first and second extension members 42, 44 of the beam support bracket 40. In the embodiments shown, the upper and lower edges 42A, 42B, 44A, 44B and the surface protrusions 22A, 22B, 24A, 24B comprise generally corresponding flat surfaces, although it should be noted that other surface configurations such as curved surfaces, locking surfaces, tongue and groove, etc. may be contemplated.

Furthermore, as shown in FIGS. 3A and 3B, the surface protrusions 22A, 22B, 24A, 24B are disposed in the inside corners of the internal receiving portion 25 of the lateral beam 20, thereby providing reinforced corner portions. Particularly, the first surface protrusions 22A and 22B are disposed on adjacent corners and in some implementations, vertically aligned corners such that the first surface protrusions 22A and 22B will mate with the first upper and lower edges 42A, 42B of the first extension member 42. Similarly, the second surface protrusions 24A and 24B are disposed on a different set of adjacent corners within the lateral beam 20 and in some implementations, vertically aligned corners such that the second surface protrusions 24A and 24B will mate with the second upper and lower edges 44A, 44B of the second extension member 44 of the beam support bracket 40.

In addition, and still referring to FIGS. 3A and 3B, the internal receiving portion 25 of the lateral beam 20 includes internal lateral surfaces, such as a first internal lateral surface 22C and a second internal lateral surface 24C. The first internal lateral surface 22C is disposed between the first upper surface protrusion 22A and the first lower surface protrusion 22B, and similarly, the second internal lateral surface 24C is disposed between the second upper surface protrusion 24A and the second lower surface protrusion 24B. In this manner, the external lateral surfaces 42C and 44C of the elongated portions 42, 44 of the support bracket 40 will correspondingly mate with the internal lateral surfaces 22C, 24C of the lateral beam 20.

Accordingly, the first surface protrusion pair 22A, 22B and the connecting internal surface 22C define a first side channel within which the first extension member 42 of the beam support bracket 40 will slide. Similarly, the second surface protrusion pair 24A, 24B and the connecting internal surface 24C define a second channel within which the second extension member 44 of the beam support bracket will slide.

Figure 4B:
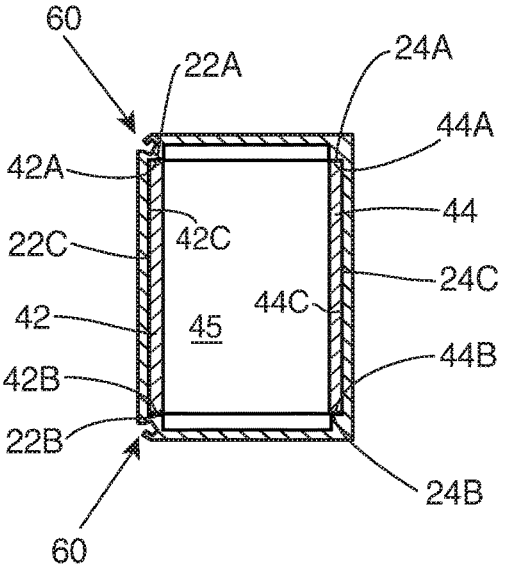
FIG. 4B is a cut-away view of FIG. 4A along line 4B-4B as illustrated therein.
Figure 4A:
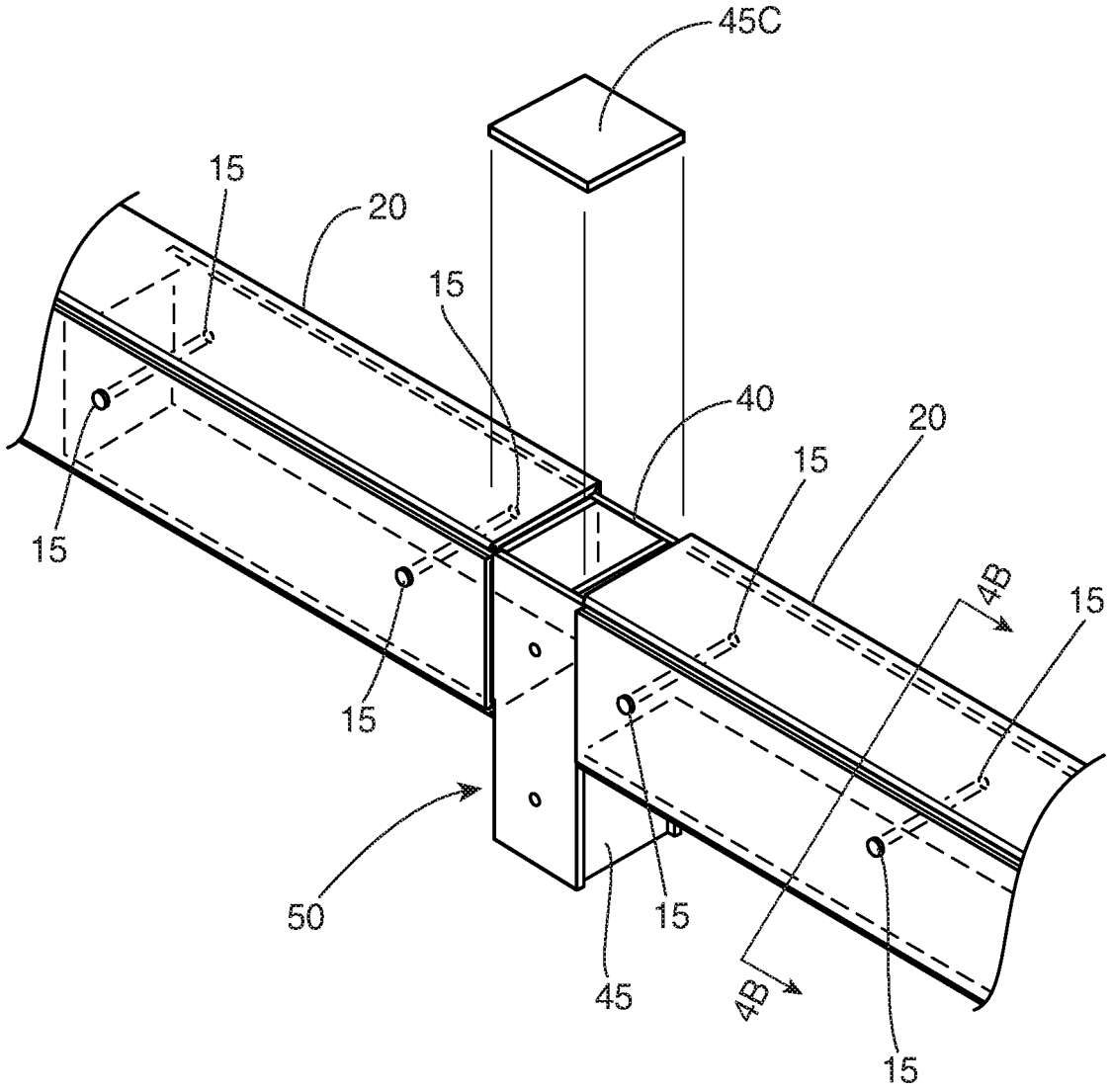
FIG. 4A is a partially exploded and cut-away view of the beam support bracket and lateral beams as disclosed in accordance with at least one embodiment of the present invention.

Furthermore, FIGS. 4A and 4B illustrate exemplary embodiments wherein the lateral beam(s) 20 is slidingly or telescopically engaged with or onto the beam support bracket 40. Particularly, FIG. 4B is a cross-sectional view taken along line 4B-4B shown in FIG. 4A. For instance, the elongated portion 41 of the beam support bracket 40 is disposed within the internal portion 25 of the lateral beam 20 in a manner such that the oppositely disposed or upper and lower edges 42A, 42B of the first extension member 42 correspondingly mate with the first surface protrusion pair (for example, defined by the first upper surface protrusion 22A and first lower surface protrusion 22B in one embodiment) and the oppositely disposed edges or upper and lower edges 44A, 44B of the second extension member 44 of the same elongated portion 41 correspondingly mate with the second surface protrusion pair (for example, defined by the second upper surface protrusion 44A and the second lower surface protrusion 44B of one embodiment). In addition, the external lateral surfaces 42C and 44C of the elongated portions 42, 44 of the support bracket 40 are correspondingly aligned or mated with the internal lateral surfaces 22C, 24C of the lateral beam 20. The lateral beam 20 may be secured to the beam support bracket 40 by way of securing one or more bolts, screws, or other like securing mechanisms through correspondingly positioned and aligned holes, as generally represented as 15. Depending on the particular beam support bracket 40, a cap 45C may be secured to a top portion of the bracket 40, such as, for example, between adjacent lateral beams 40, as shown in FIG. 4A.

In this regard, the lateral beam 20 is secured into place on the beam support bracket 20 and is prevented from twisting, rotating, or otherwise moving relative to the beam support bracket 40. Particularly, the mating engagement between the various edges 42A, 42B, 44A, 44B and the corresponding protrusions 22A, 22B, 24A, 24B, as well as the mating alignment or engagement between the surfaces 42C, 44C and 22C, 24C restrict movement between the lateral beam 20 and the beam support bracket 40. In addition, the spacer plates or spacers 45 secured between the two extension members 42, 44 maintain the appropriate spacing between the extension members 42, 44 and thereby further restrict or contribute to the movement restriction between the lateral beam 20 and the beam support bracket 40.

Figure 5:
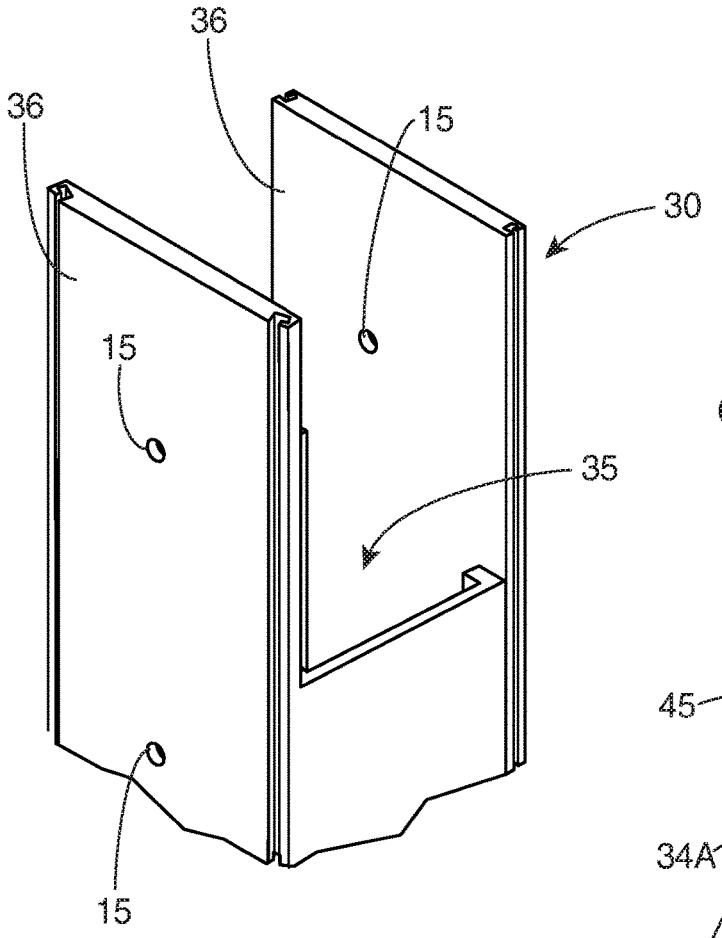
FIG. 5 is a partial end view of the support post as disclosed in accordance with at least one embodiment of the present invention.

Referring again to FIG. 2A, in at least one embodiment, the beam support bracket 40 further comprises a downward portion 50 defined by the laterally spaced first and second extension members 42, 44, for example. The downward portion 50 is structured to slidingly or telescopically fit or engage within a support post 30, in a similar manner as the elongated portion(s) 41 slidingly fit or engage within the lateral beams 20. For example, as shown in FIGS. 5 and 5A, the support post 30 includes an internal receiving portion 35 with a first surface protrusion pair 32A, 32B and a second surface protrusion pair 34A, 34B, each defining a first channel and a second channel, respectively.

Figure 5A:
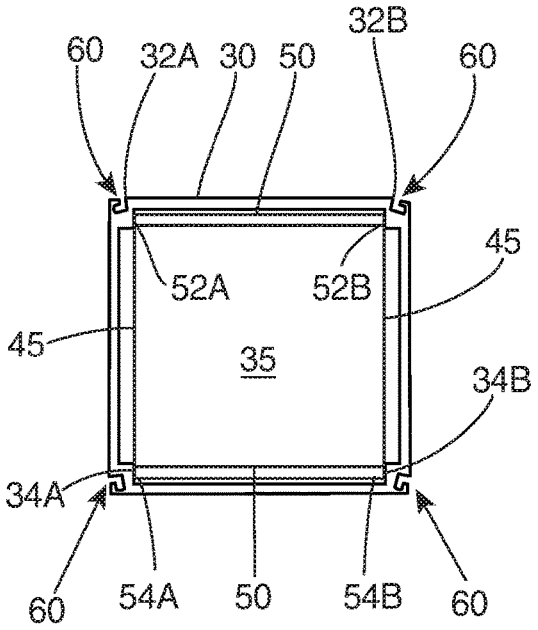
FIG. 5A is a cut away view of the interconnected support post and beam support bracket as disclosed in accordance with at least one embodiment of the present invention.

The downward portion 50 of the beam support bracket 40 includes corresponding edges 52A, 52B and 54A, 54B which correspondingly mate with the first and second channels defined by the surface protrusion portions 32A, 32B and 34A, 34B, as shown in FIG. 5A. Thus, the mating engagement between the edges 52A, 52B, 54A, 54B of the downward portion 50 and the surface protrusion portions 32A, 32B, 34A, 34B disposed in the internal receiving portion 35 of the support post 30 is structured to restrict movement, such as lateral, rotational or twisting movement between the beam support bracket 40 and the support post 30. In additional, the spacers 45 which, as above, are structured to maintain a corresponding spacing between the extension members 42, 44, may also restrict movement or contribute to the movement restriction between the beam support bracket 40 and the support post 30. Of course, screws, bolts or other securing mechanisms may be secured through or between the support post 30 and the beam support bracket 20, for example, through correspondingly aligned holes 15, which also contribute to the secure engagement and movement restriction relation between the support post 30 and the beam support bracket 20.

It should also be noted that, as illustrated in FIG. 5A, for example, the support post 50 may include a plurality of screen retention assemblies 60 for securely retaining a screen panel 5 therein. As an example, the screen retention assembly 60 may include a channel for securely retaining a portion of the screen panel 5 therein, along with a flexible or other spline for retaining the screen portion therein. Other screen retention assemblies may be incorporated within the full spirit and scope of the present invention.

In addition, the support post 30 of at least one embodiment of the present invention may include one or more upper flanges 36 extending upward beyond the interior portion 35. Accordingly, the flange(s) 36 of at least one embodiment, may extend in an at least partially overlapping relation with an external surface of the beam support bracket 40, as generally illustrated in FIG. 2A. Corresponding holes and bolts, screws or other securing mechanisms may be implemented to keep the flanges secured to the beam support bracket.

Furthermore, the support post(s) 30 of the various embodiments of the present invention may be constructed by way of metal or aluminum extrusion techniques in that the support posts(s) 30 may be a single piece of extruded aluminum or other metal. For example, in one illustrative embodiments, the support post(s) 30 may comprise 60-63 T6 extruded aluminum, although other materials may be implemented in order to facilitate the practice of the present invention in the intended manner. In addition, the support post(s) 30 of at least one exemplary embodiment may comprise a rectangular or square tube comprising a width of six (6) inches, a height of six (6) inches and a thickness of 0.25 inches. Other dimensions and configuration may be implemented within the scope of the present invention.

Figure 6:
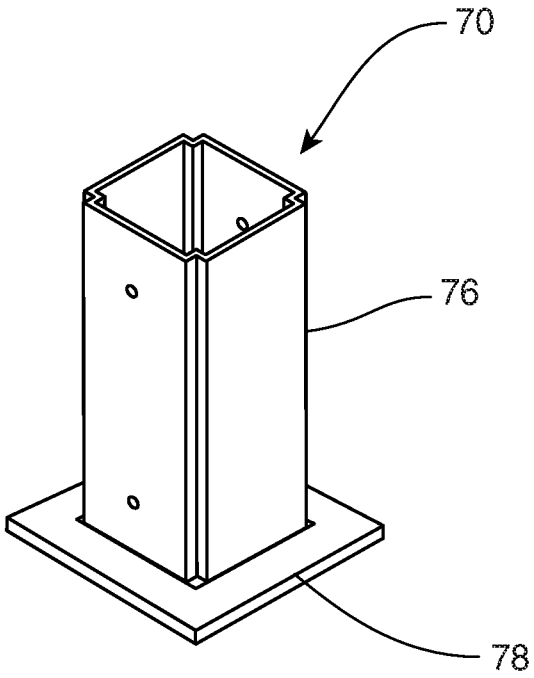
FIG. 6 is a perspective view of the support boot as disclosed in accordance with at least one embodiment of the present invention.
Figure 6A:
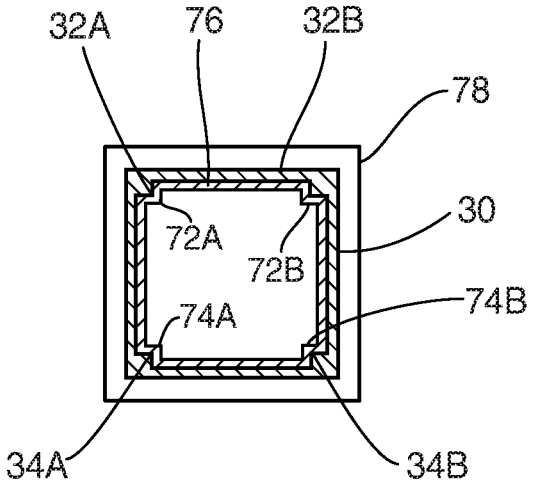
FIG. 6A is a cut-away view of the interconnected support boot and support post along line 6A-6A illustrated in FIG. 2A.

Additional features of certain embodiments of the present invention include a support boot 70 slidingly or telescopically engaged to or within a lower end of the support post 30. For example, as shown in FIGS. 6 and 6A, the support boot 70 of at least one embodiment comprises a generally upright portion 76 and a base 78. The base 78 may be flanged outward from the upright portion 76 in order to provide additional stability or support. The base 78 may be secured to a floor, concrete slab, ground, or other surface.

Further, still referring to FIGS. 6 and 6A, the upright portion 76 of the boot 70 may include surface indents or external receiving corner portions 72A, 72B, 74A, 74B which correspond to the surface protrusions 32A, 32B, 34A, 34B disposed on the inside of the support post 30, as described herein. In this manner, the surface protrusions 32A, 32B, 34A, 34B of the support post 30 will correspondingly mate with the surface indents 72A, 72B, 74A, 74B on the boot 70, proving a secure mating engagement there between. As before, the surface protrusions 32A, 32B, 34A, 34B and the surface indents 72A, 72B, 74A, 74B may be disposed on the corners of the corresponding element, as illustrated. While the surface protrusions 32A, 32B, 34A, 34B and the surface indents 72A, 72B, 74A, 74B are shown as comprising generally flat 90 degree surfaces, it is contemplated that any surface shapes may be implemented such that the surface protrusions 32A, 32B, 34A, 34B and the surface indents 72A, 72B, 74A, 74B correspondingly mate with one another and provide a secure interconnection.

Figure 7:
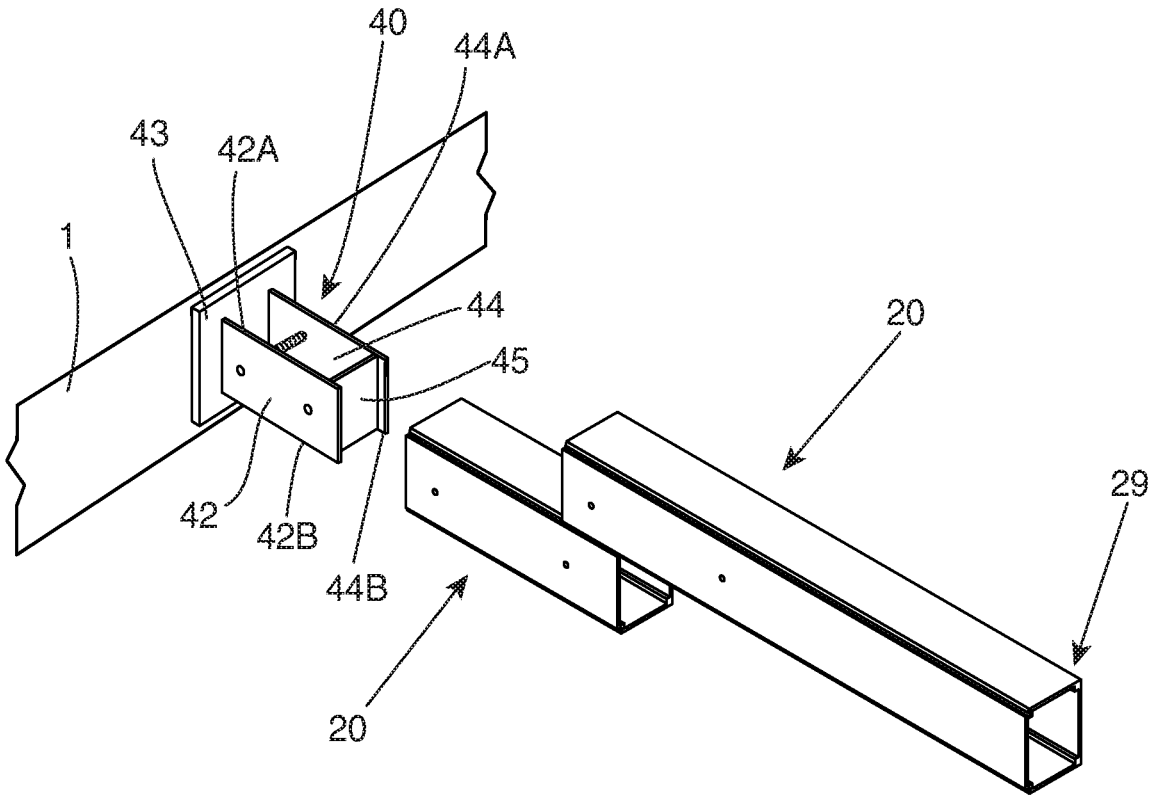
FIG. 7 is a perspective view of another beam support bracket and intermediate lateral beam as disclosed in accordance with at least one embodiment of the present invention.

Referring now to FIG. 7, yet another embodiment of the beam support bracket 40 is shown. Particularly, instead of being secured to a vertically oriented support post, the beam support bracket 40 may be secured to the structure 1, itself, such as a tie-beam, wall, post, pillar, etc. For instance, the beam support bracket 40 may include a base 43 secured to the structure 1, wherein the extension members 42, 44 extend outwardly there from. The lateral beam 20 may therefore slidingly engage with the beam support bracket 40 or extension members 42, 44, in the manner described herein. Other embodiments may include an intermediate beam 20' configured similarly to the lateral beam 20 in that the intermediate beam 20' can be slidingly engaged with the beam support bracket 40 in the same manner the lateral beam 20 can be secured, as described herein. As shown in FIG. 7, the lateral beam 20 may then be secured to the intermediate beam 20', for example, by providing bolts, screws, or other securing devices there between (not shown). The outer end 20 of the lateral beam 20 may then be slidingly engaged with another beam support bracket 40 to assemble the support assembly of the present invention.

Referring now to FIGS. 8A through 11, yet another embodiment of the support assembly 10 is illustrated. Specifically, in this embodiment, the support plates 42, 44 of the beam support bracket 40 may be disconnected, such that they are independent from one another. As described herein, the support plates 42, 44 are cooperatively configured with the internal portion 25 of the lateral beam(s) 20 such that the support plates 42, 44 slide within cooperatively structured channels so as to securely retain the beam(s) 20 onto the support plate(s) 42, 44.

Figure 9:
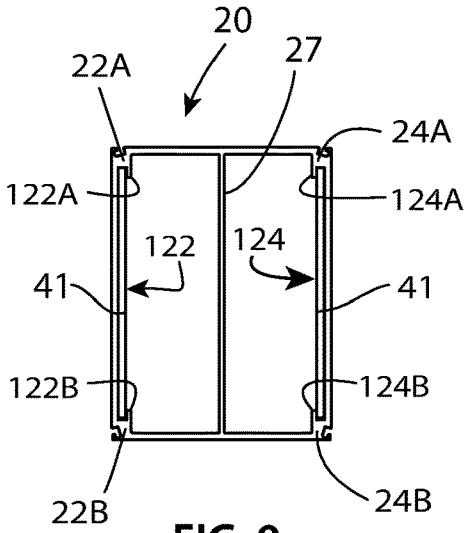
FIG. 9 is a cut-away view of the lateral beam along line 9-9 illustrated in FIG. 8C.

Particularly, with reference to the cut-away view of FIG. 9, the surface protrusions 22A, 22B are configured to define a first receiving channel 122 there between, and surface protrusions 24A, 24B are configured to define a second receiving channel 124. As provided above with regard to other embodiments, the elongated portion(s) 41 of the support plates 42, 44 are slidingly disposed within the receiving channels 122, 124. Still referring to FIG. 9, in at least one embodiment, the surface protrusions 22A, 22B include an extended lip 122A and 122B, respectively. Similarly, the surface protrusions 24A and 24B each include a corresponding extend lip 124A and 124B. These extended lips 122A, 122B, 124A, 124B are structured to further define the corresponding channels 122, 124, as well as facilitate in the retention of the support plate(s) 42, 44 and in particular the extended or elongated portions 41 thereof within the channels 122, 124. Specifically, the extended lips 122A, 122B, 124A and 124B extend from the corresponding surface protrusion and at least partially define the channel within which the support plate is disposed.

Still referring to FIG. 9, at least one embodiment of the present invention may further include a reinforcement wall or panel 27 disposed within the internal receiving portion of the lateral beam(s) 20. Particularly, the reinforcement wall or panel 27 may span across or between oppositely disposed surfaces or wall of the lateral beam 20 separating the internal receiving portion into at least two portions, such that the first receiving channel 122 and the second receiving channel 124 are disposed within different portions, as illustrated in FIG. 9. The reinforcement wall or panel 27 may extend longitudinally along the entire or a substantial portion of the lateral beam 20. This provides additional rigidity and strength to the lateral beam 20.

Figure 10:
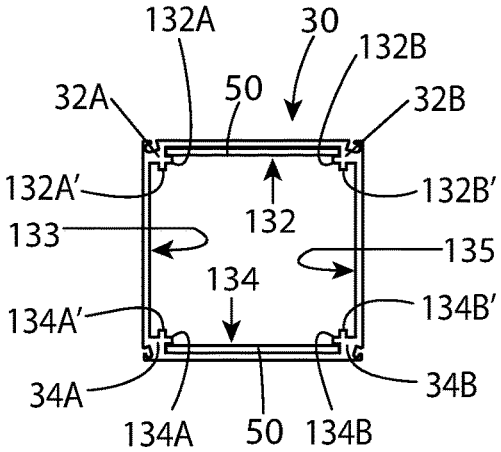
FIG. 10 is a cut-away view of the support post along line 10-10 illustrated in FIG. 8C.

FIG. 10 illustrates a cut-away view of the support post 30 showing the downward portions 50 of the support plates 42, 44 inserted therein. Particularly, as described herein, the support post 30 of at least one embodiment includes at least two elongated peripheral channels 132, 133, 134, 135 defined by a plurality of surface protrusions 32A, 32B, 34A, 34B. As shown in FIG. 10, the downward portions 50 of the support plates 42, 44 are inserted or slidingly engaged within two of the channels 132 and 134. However, it should be noted that, in at least one embodiment, the support bracket 40 may include more than two downward portions 50, such as in the corner embodiment illustrated in FIG. 12A. In that embodiment, the downward portions of the support plates may fit within three or all four of the channels 132, 133, 134, 135.

In any event, referring back to FIG. 10, in at least one embodiment, the plurality of surface protrusions 32A, 32B, 34A, 34B of the support post 30 may include extended lips or extensions generally referenced as 132A, 132A', 132B, 132B', 134A, 134A', 134B, 134B'. These extended lips or extensions further define the elongated peripheral channels within which the downward portion 50 of the support plate(s) 42, 44 may be disposed.

Figure 11:
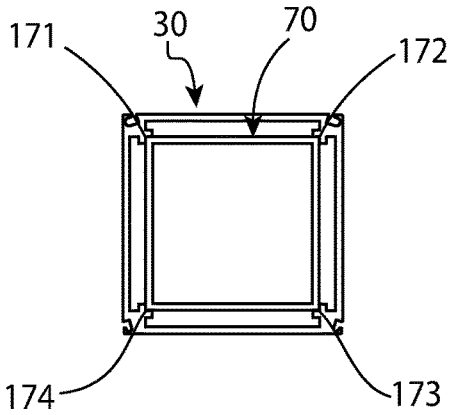
FIG. 11 is a cut-away view of the support post along line 11-11 illustrated in FIG. 8C.

Furthermore, the extended lips of the support post 30 may also define a center channel through which the support boot 70 may be disposed. For instance, the support boot 70 may include external corner surfaces or portions 171, 172, 173, 174 that engage or mate with the surface protrusions on the interior of the support post 30. Particularly, in the embodiments shown, the extended lips or extensions of the surface protrusions may define L-shaped corner receiving portions that will mate with the corners of the support boot 70, as shown in FIG. 11, for example.

Referring back to FIG. 8A, the support plates 42, 44 of at least one embodiment further include a plurality of notches 145, for example, where the lateral elongated portion 41 and the downwardly extended portion 50 meet. It should be noted that both of the support plates 42, 44 are identical in construction such that the they both include notches 145, even though the notches in the support plate 44 are not visible in FIG. 8A.

Specifically, the notches 145 are structured to receive a corresponding upper edge 135 of the support post 30 therein when the downward portion 50 of the support plate is slidingly disposed within the support post 30, as described herein. For example, FIG. 8B illustrates a front plan view wherein the support plate 42 is disposed within the support post 30 and the notches 145 have received the upper edge 135 of the support post 30 therein. In this manner, the lower edge 42B of the elongated portion 41 of the support plate 42 may extend or be disposed slightly below the upper edge 135 of the support post 30.

Figure 8A:
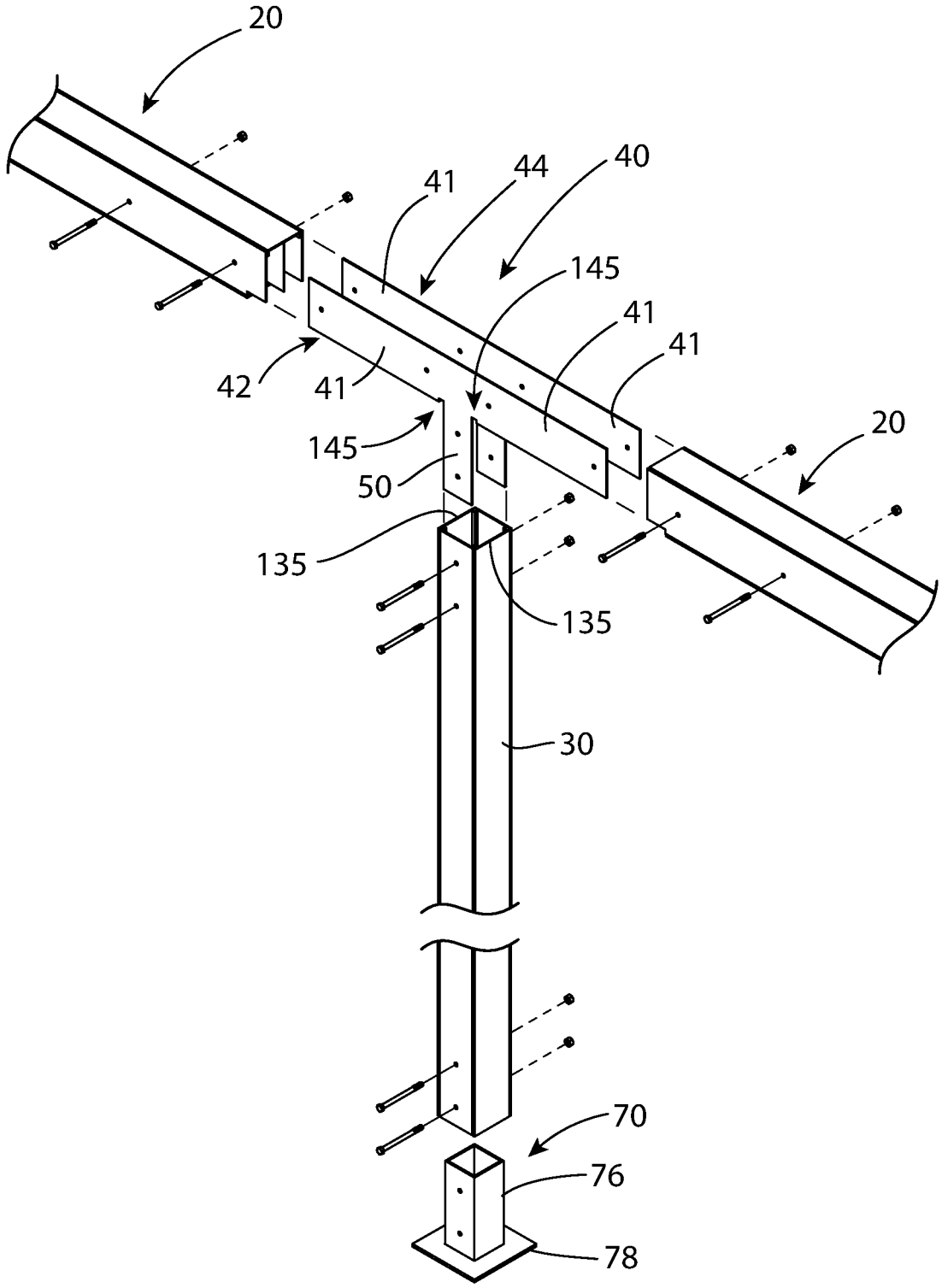
FIG. 8A is a perspective and partially exploded view of yet another embodiment of the present invention.
Figure 8B:
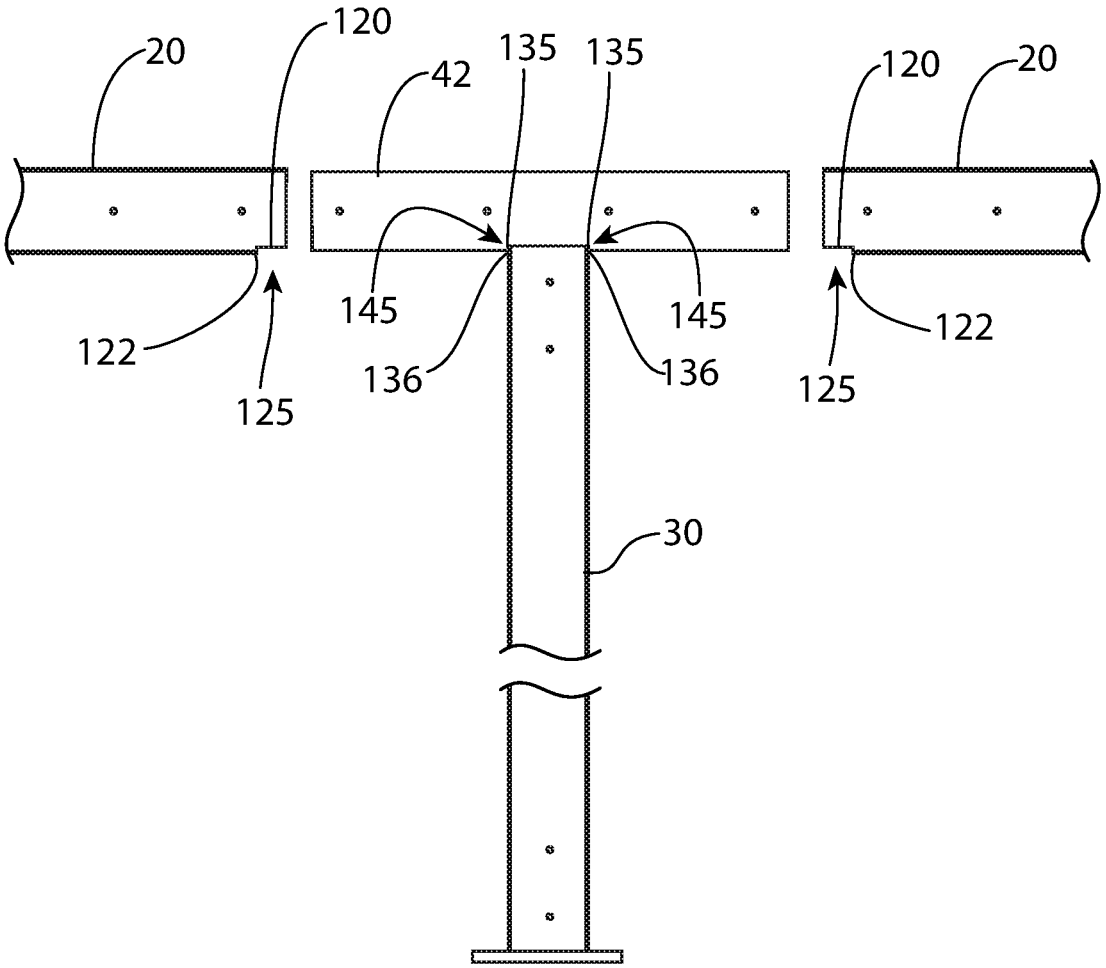
FIG. 8B is an elevation and partially exploded view of the embodiment illustrated in FIG. 8A.
Figure 8C:
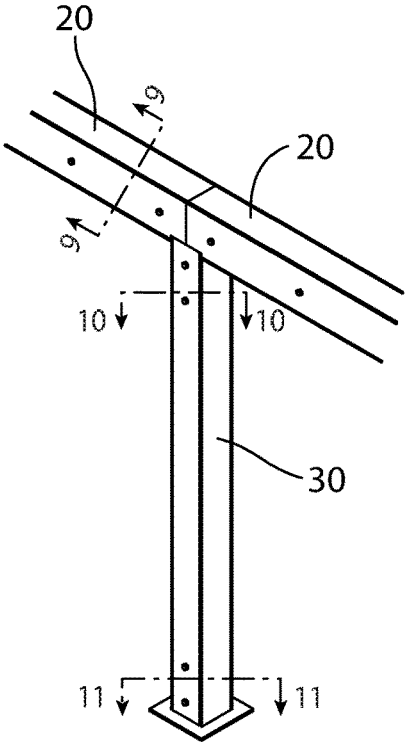
FIG. 8C is a perspective, assembled view of the embodiment illustrated in FIGS. 8A and 8B.

Furthermore, still referring to FIGS. 8A and 8B, the lateral beam(s) 20 of at least one embodiment may include a notch 125 disposed on at least one end 21, 29 of the beam 20. The notch 125 may be defined by a recessed lower edge 120 and a recessed lip 122, as shown in FIG. 8B. The recessed lower edge will be disposed at least partially over or on top of the upper edge 135 of the support post 30, and the recessed lip 122 will mate with an upper portion or surface 136 of the support post 130. The connected assembly is illustrated in FIG. 8C.

Figure 12A:
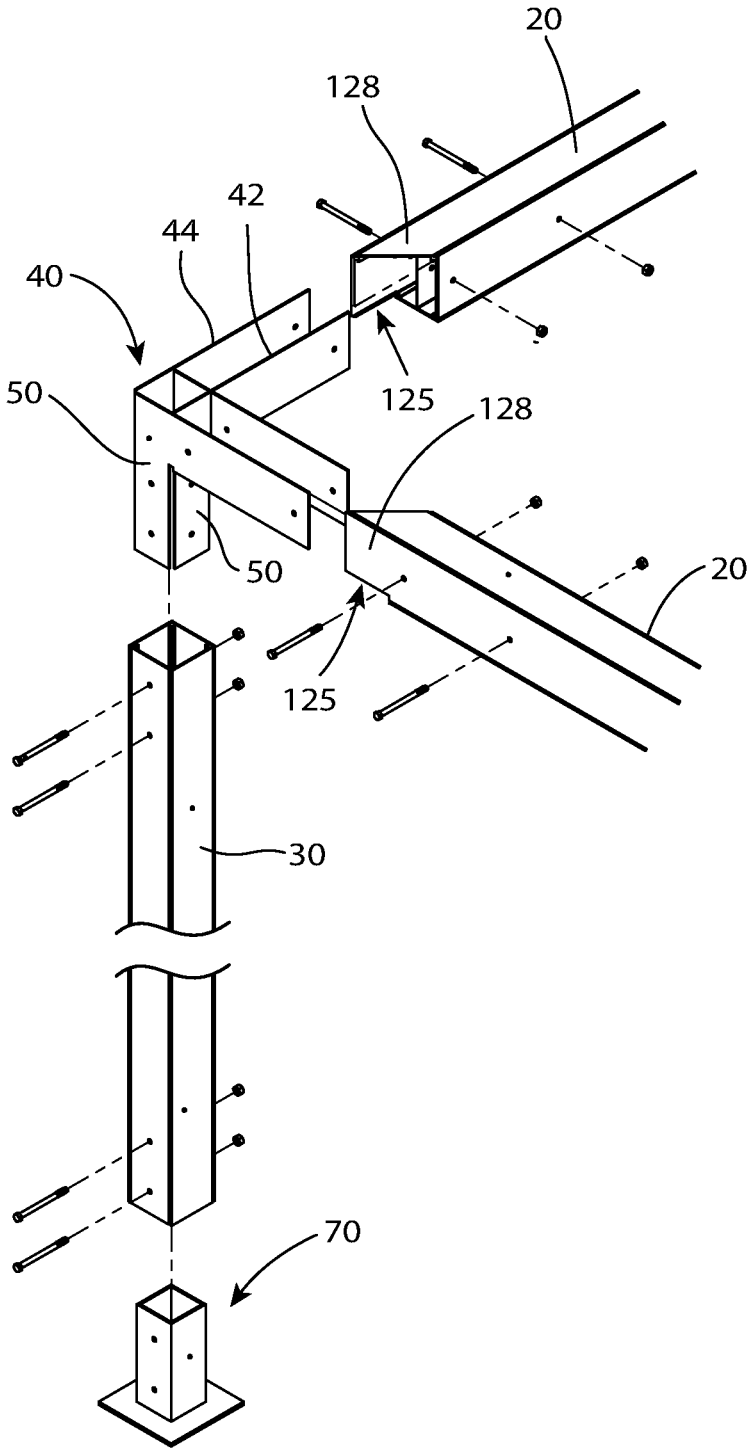
FIG. 12A is a perspective and exploded view of yet another embodiment of the present invention.
Figure 12B:
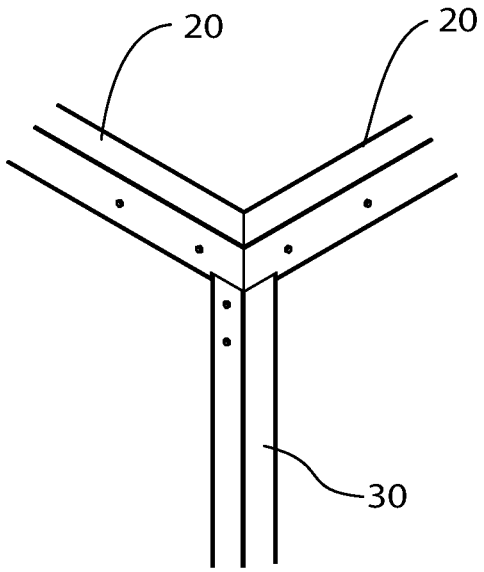
FIG. 12B is a perspective and assembled view of the embodiment illustrated in FIG. 12A.

Referring now to FIGS. 12A and 12B, yet another embodiment of the present invention is illustrated, and in particular, a corner embodiment is shown. Specifically, the bracket 40 may include one or more support plates 42, 44 with elongated portions 41 and one or more downward extended portions 50, as provided herein, although configured to be implemented or assembled on a corner. In the illustrated embodiment, the bracket 40 includes four downward portions 50, which correspondingly fit within the four elongated peripheral channels on the interior of the support post 30.

Furthermore, the lateral beams 20 may include corner extensions 128 on at least one end so as to extend all the way to the corner and meet with one another, as shown in FIG. 12B.

Figure 13B:
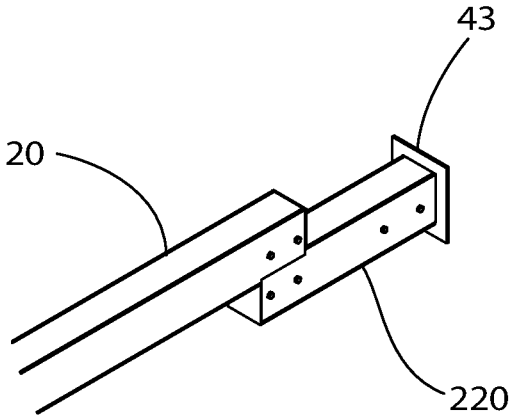
FIG. 13B is a perspective and assembled view of the embodiment illustrated in FIG. 13A.
Figure 13A:
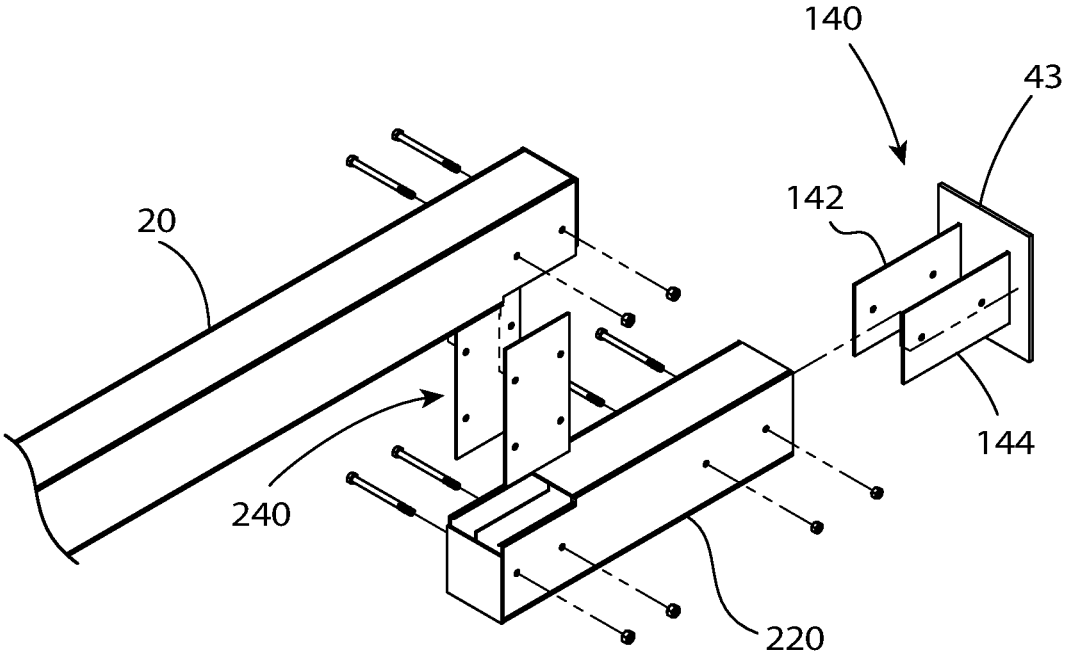
FIG. 13A is a perspective and exploded view of yet another embodiment of the present invention.

FIGS. 13A and 13B illustrate another embodiment of the support assembly 10. Particularly, instead of being secured to a vertically oriented support post, at least one beam support bracket 140 may be secured to the structure, itself, such as a tie-beam, wall, post, pillar, etc., or to an existing post. For instance, the beam support bracket 140 of this embodiment may include a base 43 secured to the structure, wherein the extension members 142, 144 extend outwardly there from. Although not shown, the lateral beam 20 may therefore slidingly engage with the beam support bracket 140 or extension members 142, 144, in the manner described herein. Other embodiments, as illustrated in FIGS. 13A and 13B, may include an intermediate beam 220 configured to slidingly engage with the beam support bracket 140 in the same manner as the lateral beam 20 can be secured, as described herein. As shown in FIG. 13A, the lateral beam 20 may then be secured to the intermediate beam 220, for example via an additional support bracket 240. In particular, the additional support bracket 240 may include two spaced apart support plates that slidingly engage between the lateral beam 20 and the intermediate beam 220 via receiving channels in a similar manner as described herein, for example, via surface protrusions disposed on the interior surfaces of the corresponding beams 20, 220 to define corresponding receiving channels.

Figure 14A:
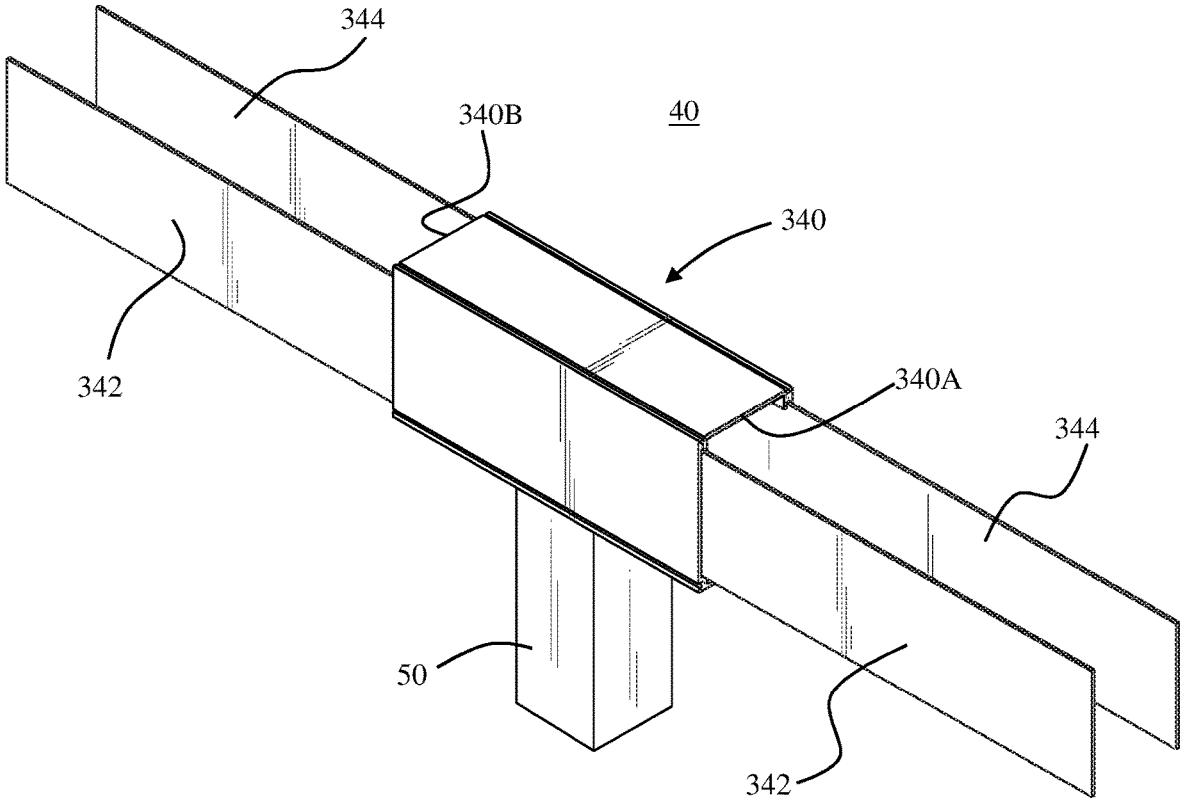
FIG. 14A is a perspective view of the beam support bracket of yet another embodiment of the present invention.

With reference now to FIGS. 14A through 19, yet another embodiment of the support assembly is illustrated. In particular, in this embodiment, the beam support bracket 40 includes a body 340 and at least two elongated extension members 342, 344 extending from an end 340A and/or 340B. Specifically, as shown in FIGS. 14A and 14B, the body 340 of the beam support bracket 40 of at least one embodiment includes an internal receiving portion 345. A first surface protrusion pair 322A, 322B and a second surface protrusion pair 324A, 324B are disposed on the inside of the body 340, for example, along the four internal corners or edges as shown.

In this manner, the a first elongated extension member 342 may be disposed within or at least partially between the first surface protrusion pair 322A, 322B, and a second elongated extension member 344 can be disposed at least partially between the second surface protrusion pairs 324A, 324B. As illustrated, the elongated extension members 342, 344 can be generally flat elongated pieces of material, such as metal, aluminum, plastic, etc. that first snugly between the surface protrusions of the body 340. It should be noted that other shapes of the elongate extension members 342, 344 of the various embodiments disclosed herein are contemplated, for instance, other than being flat as illustrated.

Furthermore, the elongated extension members 342, 344 can be secured to the body 340 via virtually any manner, including, but not limited to, one or more screws, bolts, or other like fasteners. In other embodiments, the elongated extension members 342, 344 can be welded to the body 340 or even integrated or constructed as a single piece.

Figure 14B:
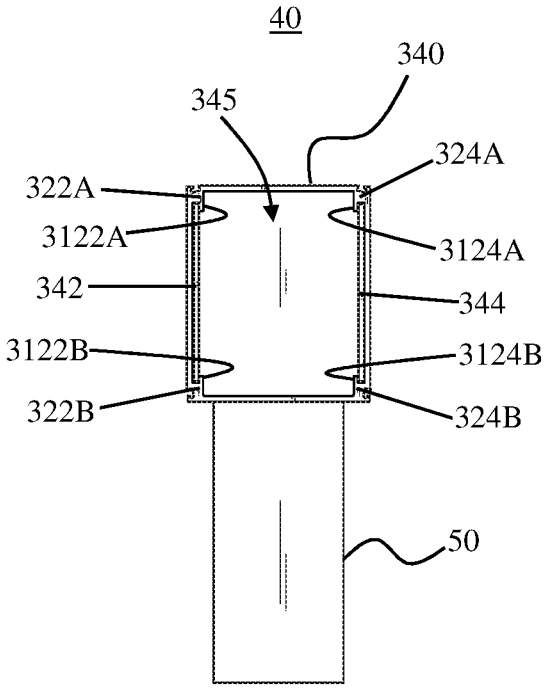
FIG. 14B is right side view of the beam support bracket illustrated in FIG. 14A.

As shown in FIG. 14B, each of the surface protrusions 322A, 322B, 324A, 324B of at least one embodiment can also include a lip 3122A, 3122B, 3124A, 3124B, respectively. The lips of each pair, e.g., 3122A, 3122B, extend from the corresponding surface protrusion, e.g., 322A, 322B, toward one another. This at least partially defines or creates a receiving channel there between, within which the corresponding extension member, e.g., 342, is disposed.

Referring again to FIG. 14A, the beam support bracket 40 of at least one embodiment can include extension members 342, 344 extending outward from two ends, such as first end 340A and second end 340B. For example, in one embodiment (e.g., when the body 340 comprises a linear configuration as shown in FIGS. 14A, 14B) a single extension member, for example, extension member 342, can, in some cases, extend all the way through the body 340 such that the extension member 342 extends from both ends 340A, 340B of the body 340. Similarly, the other extension member 344 can, in some cases, extend all the way through the body 340 such that the extension member 344 extends from both ends 340, 340B of the body 340. In other embodiments, however, the beam support bracket 340 can include four (4) separate extension members, such that two (2) extend from one end 340B, and the other two (2) extend from the second end 340B.

Figure 15A:
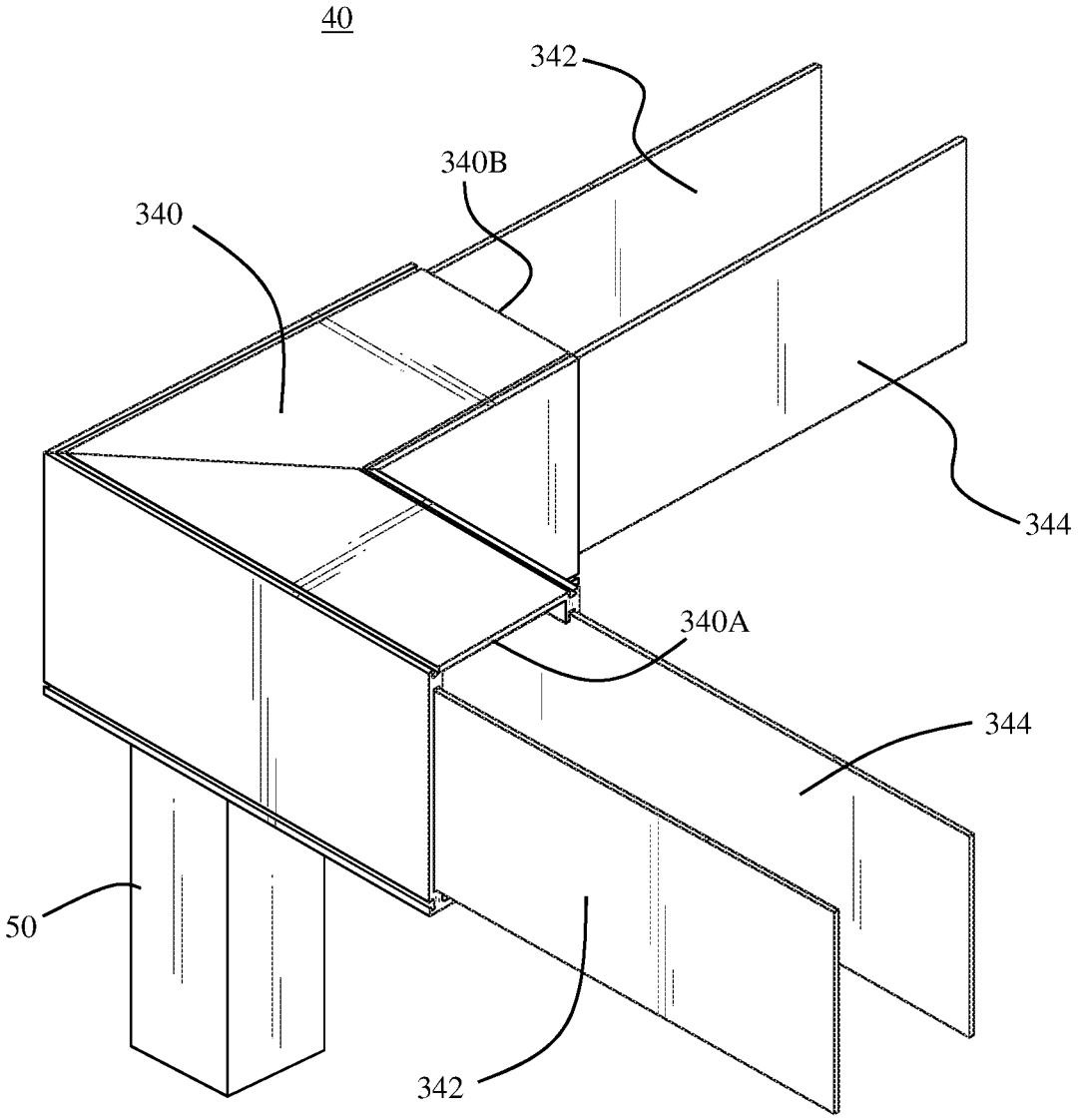
FIG. 15A is a perspective view of the beam support bracket of another embodiment of the present invention.
Figure 15B:
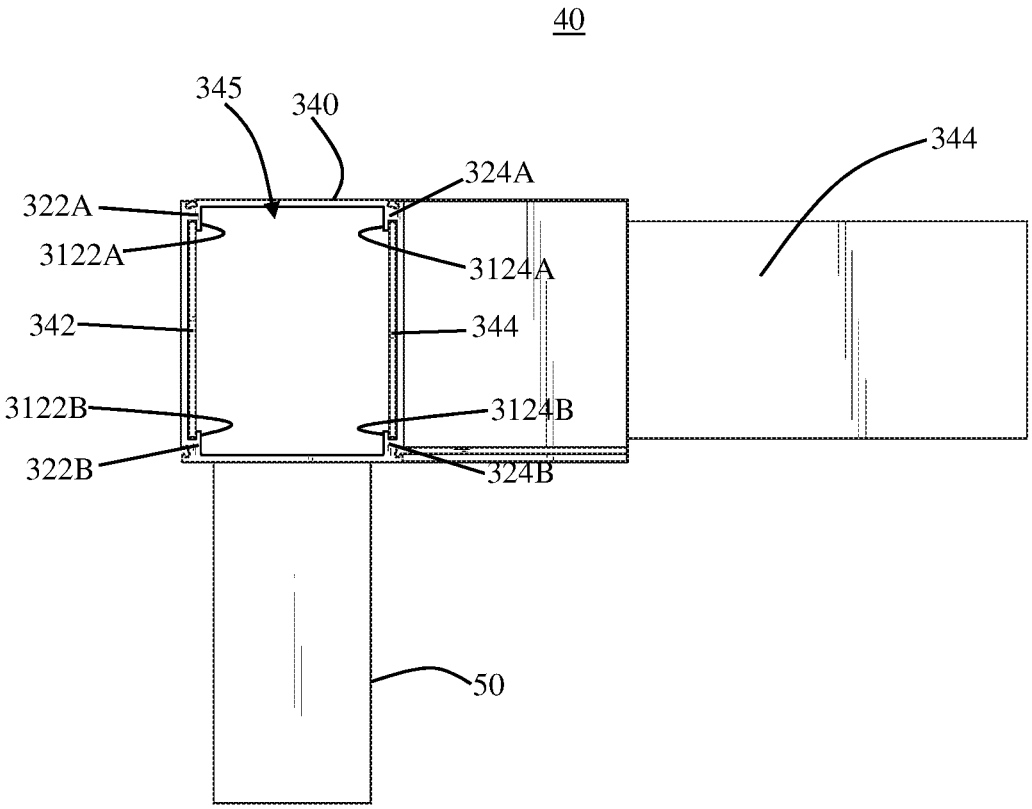
FIG. 15B is a right side view of the beam support bracket illustrated in FIG. 15A.

Furthermore, with reference to FIGS. 15A and 15B, the beam support bracket 40 may include an angled configuration. In the embodiment shown, the bracket 40 exhibits a ninety degree angle, however, other angles are contemplated. Again, the bracket 40 includes a plurality of at least two elongated extension members 342, 344 extending outwardly from at least one end 340A, 340B. The cross-section or end view of the body 340 of FIGS. 15A, 15B is the same as the cross section or end view of the body of FIG. 14A, 14B.

Figure 16A:
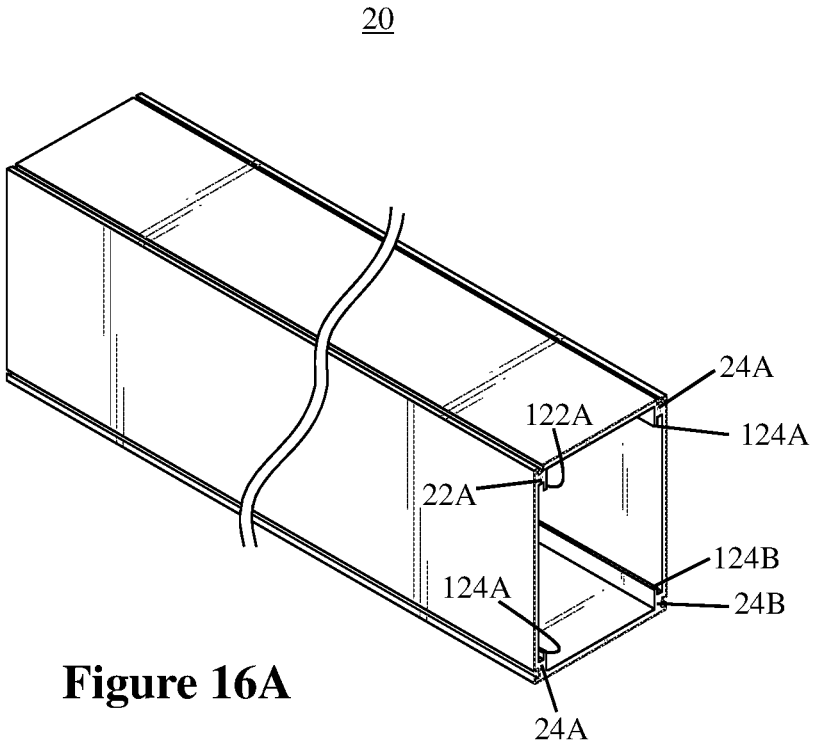
FIG. 16A is a perspective view of the lateral beam as disclosed in accordance with at least one embodiment of the present invention with break-away lines indicating indeterminate length.
Figure 16B:
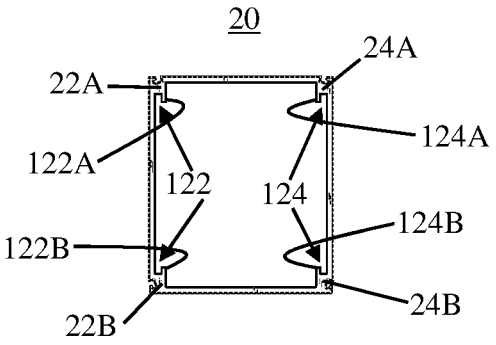
FIG. 16B is an end view of the lateral beam illustrated in FIG. 16A.

In addition, referring now to FIGS. 16A and 16B, the lateral beam 20 of at least one embodiment is illustrated. Particularly, the lateral beam 20 illustrated may include a similar cross section as the body 340 of the beam support bracket 40 in that the lateral beam 20 can include surface protrusions 22A, 22B and 24A, 24B disposed on or within an internal surface thereof. In some embodiments, each of the surface protrusions 22A, 22B, 24A, 24B may be configured to define or otherwise include an extended lip 122A, 122B, 124A, 124B, respectively. These extended lips 122A, 122B, 124A, 124B are structured to at least partially define a corresponding channel 122, 124, as well as facilitate in the retention of the support plate(s) or extension members 342, 344 within the channels 122, 124.

It should be noted that the lateral beam illustrated in FIGS. 16A and 16B may be constructed in a similar manner to the body 340 illustrated in FIGS. 14A, 14B, although with different lengths. The body 340 of the corner or angled bracket 40 illustrated in FIGS. 15A, 15B can also be constructed from the same or similar beam, but instead with angular cuts or bends to create the angled configuration.

Figure 17:
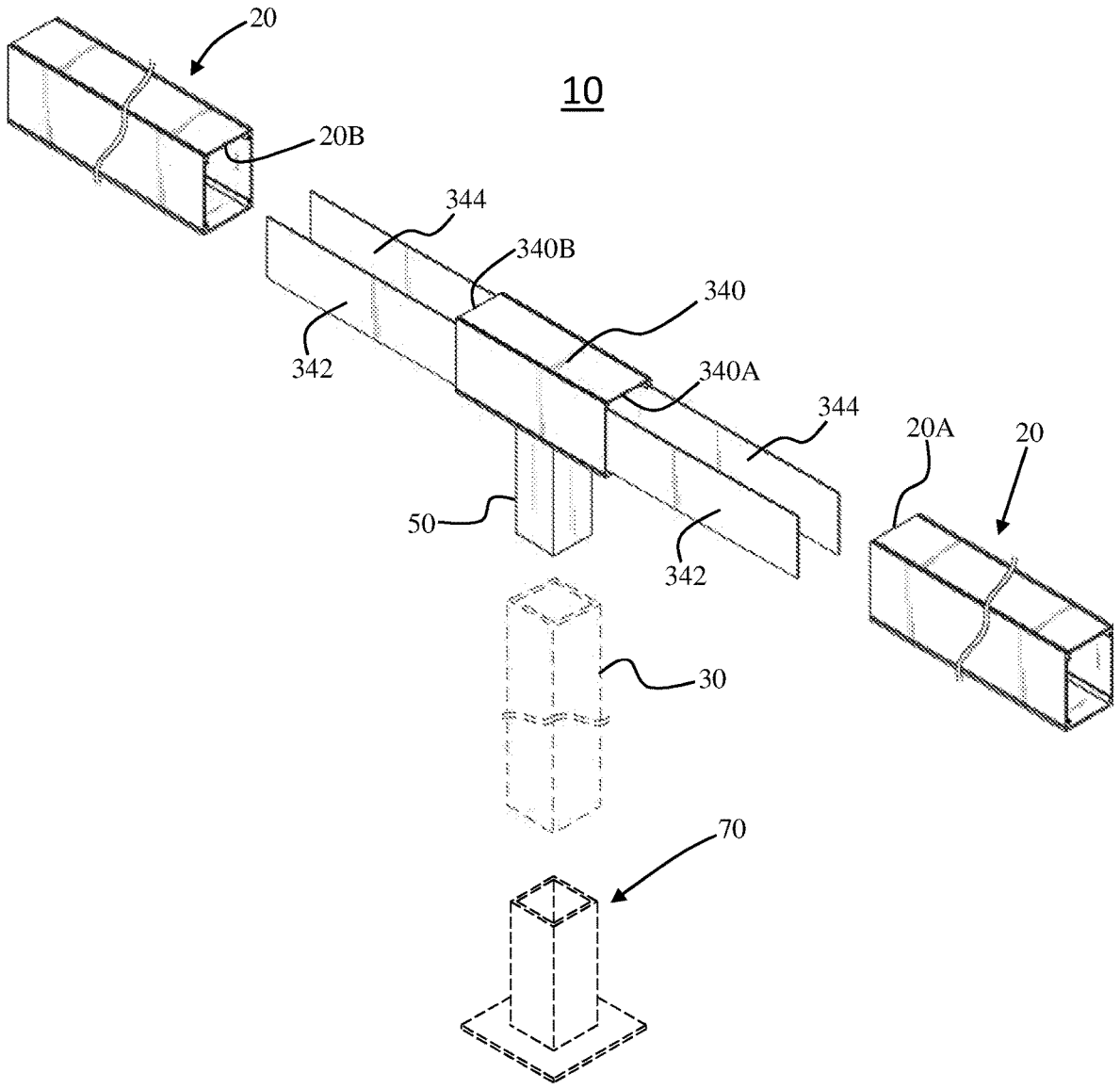
FIG. 17 is an exploded view of at least a portion of the support assembly as disclose din accordance with at least one embodiment of the present invention, with break-away lines indicating indeterminate length.

For instance, as shown in the exploded view of FIG. 17, the beam support bracket 40 of at least one embodiment may engage with a support post 30 via downward portion 50. Extension members 342, 344 extending from the body 340 of the beam support bracket will slidingly engaged lateral beam(s) 20, in the manner described herein. In this embodiment, a first end 340A of the body 340 will mate flush against a corresponding end 20A of a corresponding lateral beam 20, and a second end 340B of the body 340 will mate flush against a corresponding end 20B of a corresponding lateral beam 20. This can also be seen in the exemplary assembled support assembly 10 illustrated in FIG. 19.

Figure 18:
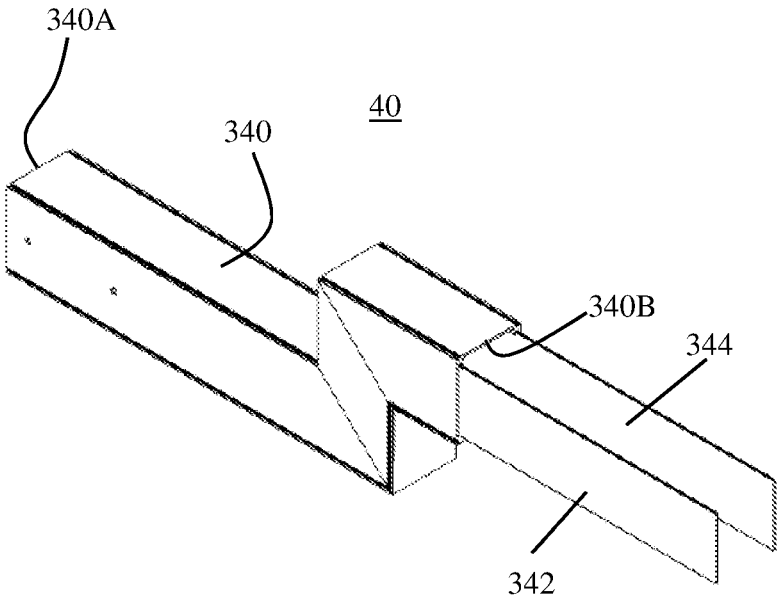
FIG. 18 is a perspective view of a beam support bracket as disclosed in accordance with yet another embodiment is the present invention.
Figure 19:
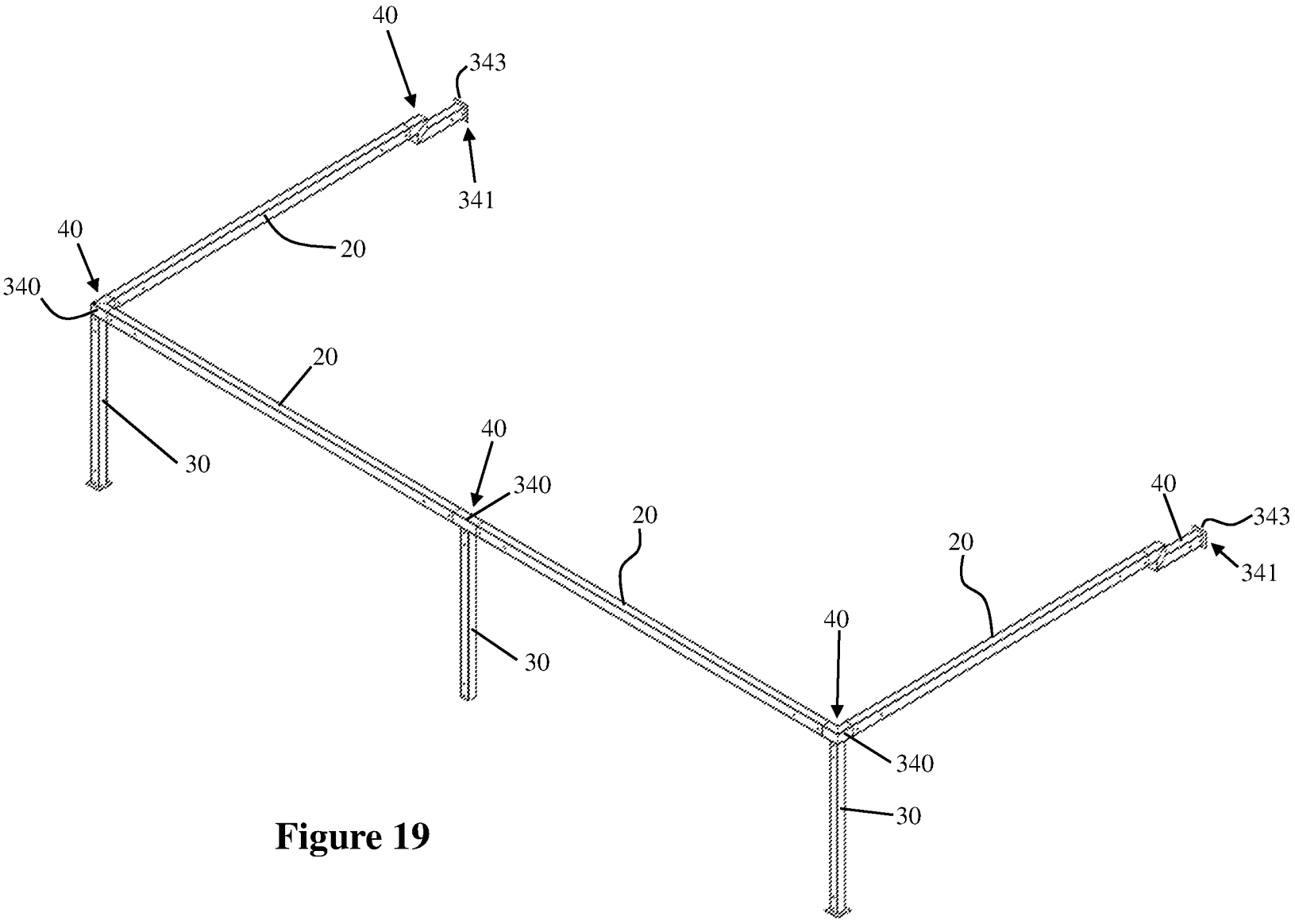
FIG. 19 is a perspective view of an exemplary support assembly as disclosed herein.

Referring now to FIG. 18, and similar to FIG. 7, yet another embodiment of the beam support bracket 340 is shown. Particularly, instead of being secured to a vertically oriented support post, the beam support bracket 340 illustrated in FIG. 18 may be secured to the structure 1, itself, such as a tie-beam, wall, post, pillar, etc., via a mounting bracket 341. For instance, the mounting bracket 341 of the beam support bracket 340 may include a base 343 secured to the structure 1, wherein the extension members 342, 344 (not shown) extend outwardly there from. The first end 340A of the body 340 may therefore slidingly engage extension members (not shown) extending from mounting bracket 341 in the manner described herein. Additional extension members 342, 344 extend outward from the second end 340B of the body 340, as shown in FIG. 18, which will then slidingly engage with the lateral beam 20, as provided herein.

With reference now to FIGS. 20A through 27, additional embodiments of the support assembly and brackets thereof are illustrated. In particular, in this embodiment, the beam support bracket 40 includes a body 340 and one or more support members 400 extending from an end 340A and/or 340B thereof.

For instance, the support member(s) 400 of at least one embodiment includes two extension members 442, 444 interconnected to one another via an intermediate connecting member 445. As illustrated, the support member(s) 400 can be constructed as or otherwise include an I-beam such that a cross section of the support member(s) 400 generally represents or is similar to the capital letter "I." For instance, the two elongated extension members 442, 444 may be parallel to one another, with the intermediate connecting member 445 extending perpendicularly therebetween along the entire length of the two extension members 442, 444. Other configurations are contemplated in that the extension members 442, 444 can be connected to one another in other ways in addition to or instead of intermediate connecting member 445.

In this manner, a first elongated extension member 442 of one support member 400 may be disposed within or at least partially between the first surface protrusion pair 322A, 322B of body 340, and a second elongated extension member 344 of the support member 400 can be disposed at least partially between the second surface protrusion pairs 324A, 324B of body 340. As illustrated, the elongated extension members 442, 444 can be generally flat elongated pieces of material, such as metal, aluminum, plastic, etc. that first snugly between the surface protrusions of the body 340. It should be noted that other shapes of the elongate extension members 442, 444 of the various embodiments disclosed herein are contemplated, for instance, other than being flat as illustrated.

Furthermore, the elongated extension members 442, 444 can be secured to the body 340 via virtually any manner, including, but not limited to, one or more screws, bolts, or other like fasteners 402. In other embodiments, the elongated extension members 442, 444 can be welded to the body 340 or even integrated or constructed as a single piece.

Figure 20A:
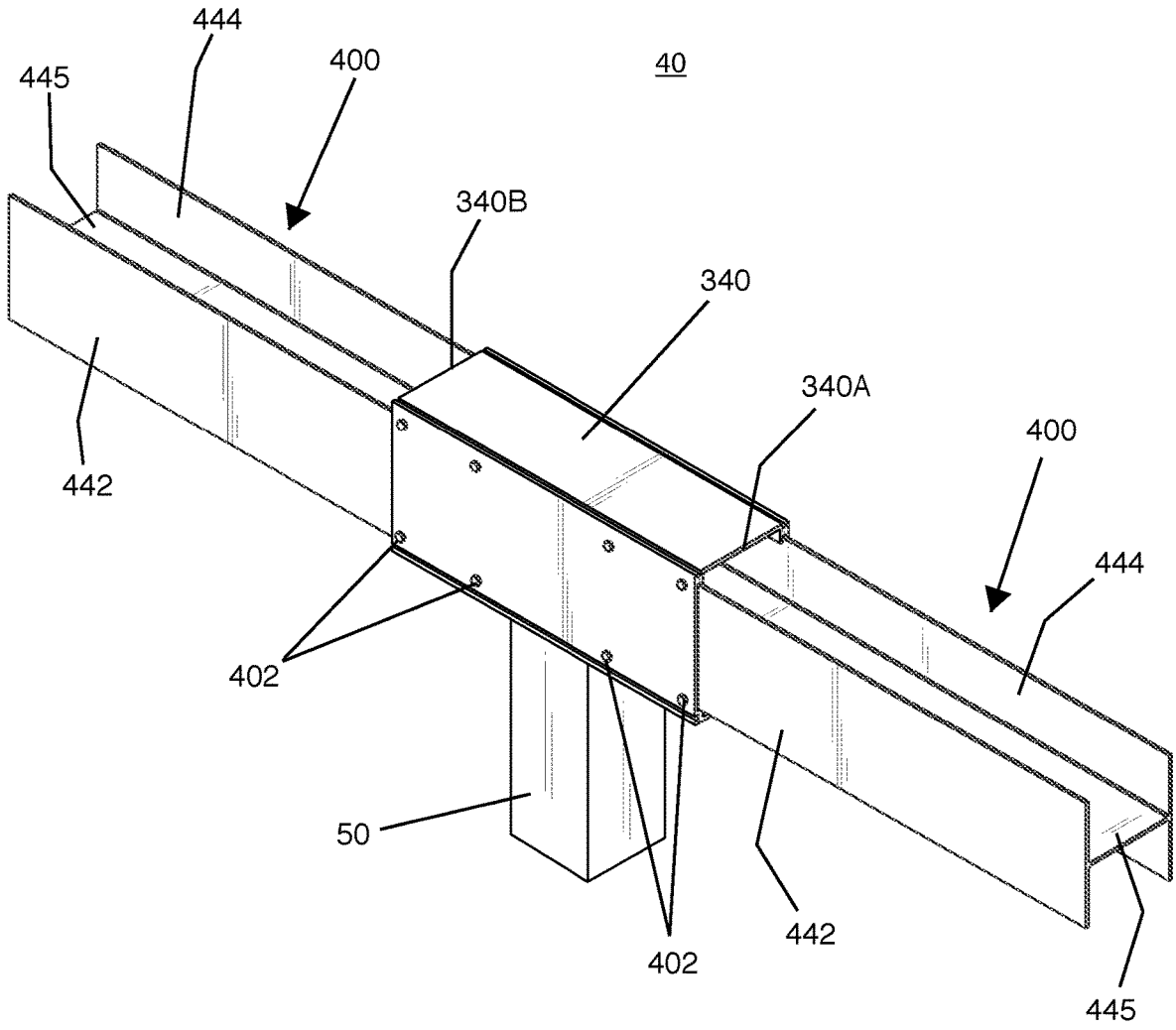
FIG. 20A is a perspective view of the beam support bracket of yet another embodiment of the present invention.
Figure 20B:
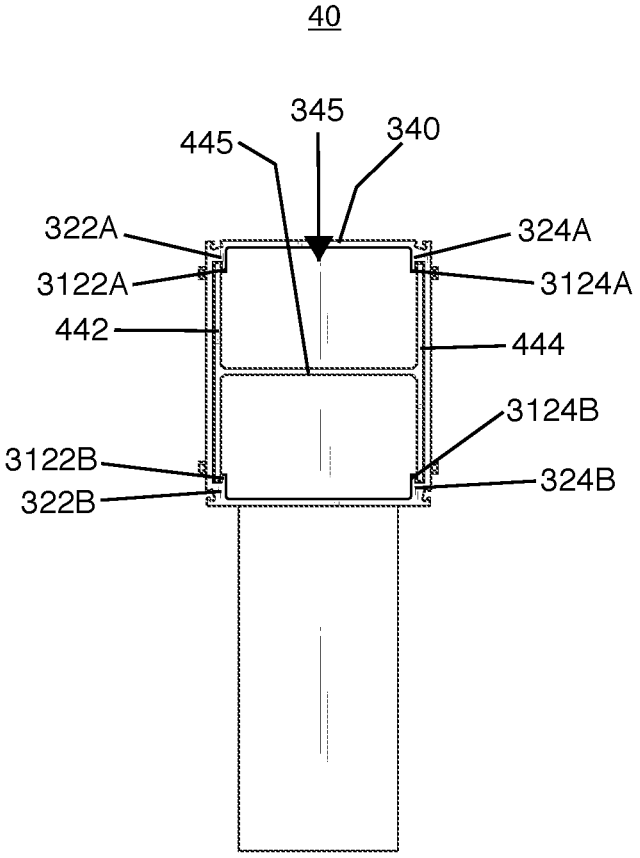
FIG. 20B is a side view of the beam support bracket illustrated in FIG. 20A.

As shown in FIG. 20B, each of the surface protrusions 322A, 322B, 324A, 324B of at least one embodiment can also include a lip 3122A, 3122B, 3124A, 3124B, respectively. The lips of each pair, e.g., 3122A, 3122B, extend from the corresponding surface protrusion, e.g., 322A, 322B, toward one another. This at least partially defines or creates a receiving channel there between, within which the corresponding extension member, e.g., 442, is disposed.

Figure 20C:
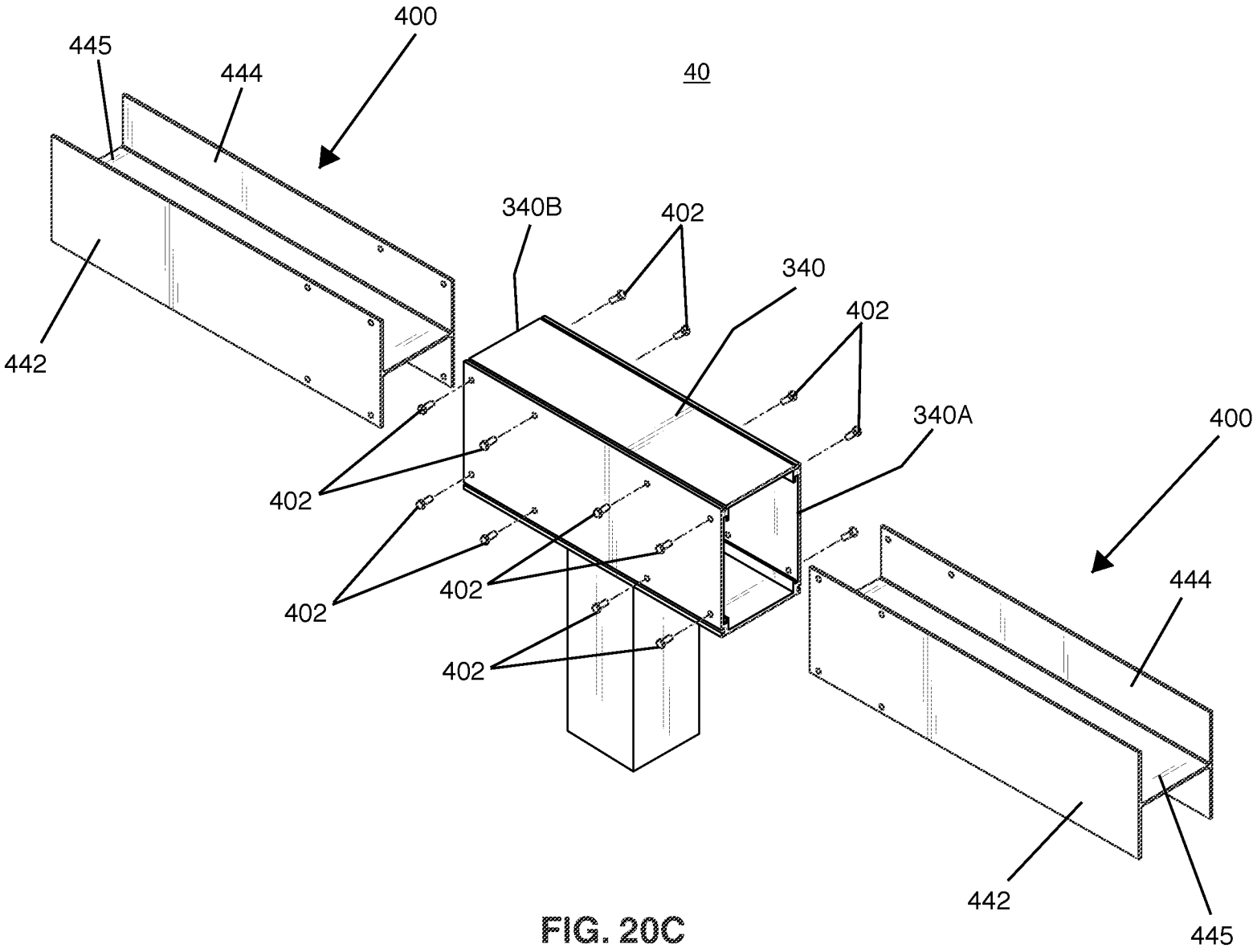
FIG. 20C is an exploded perspective view of the beam support bracket illustrated in FIGS. 20A and 20B.

Referring to FIGS. 20A and 20C, the beam support bracket 340 of at least one embodiment can include two separate support members 400 extending outwardly from two ends, such as first end 340A and second end 340B. It should be noted however, that in one embodiment (e.g., when the body 340 comprises a linear or straight configuration) a single support member 400 can, in some cases, extend all the way through the body 340 such that a single support member 400 extends from both ends 340A, 340B of the body 340.

Figure 21A:
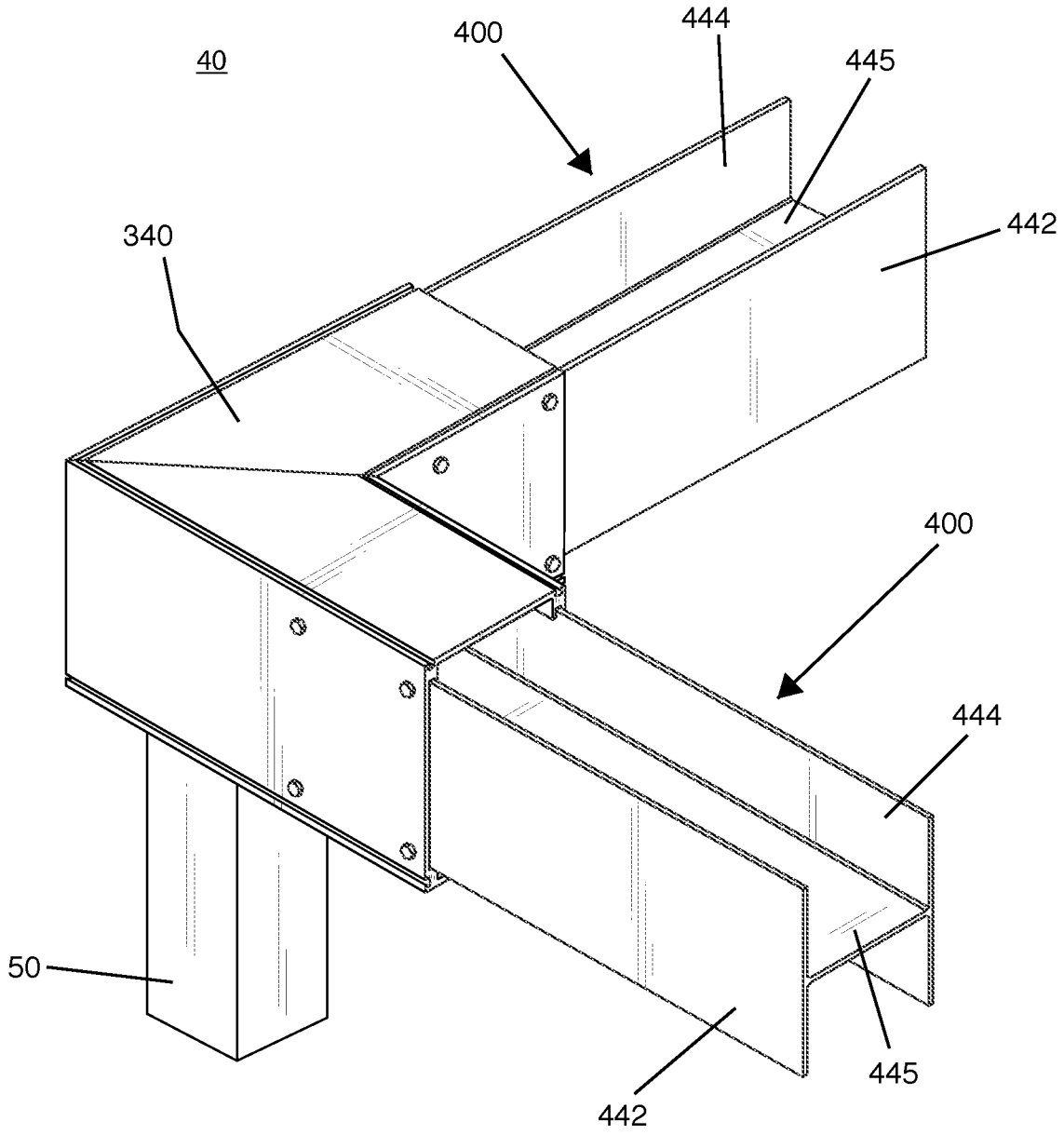
FIG. 21A is a perspective view of another beam support bracket as disclosed herein.
Figure 21B:
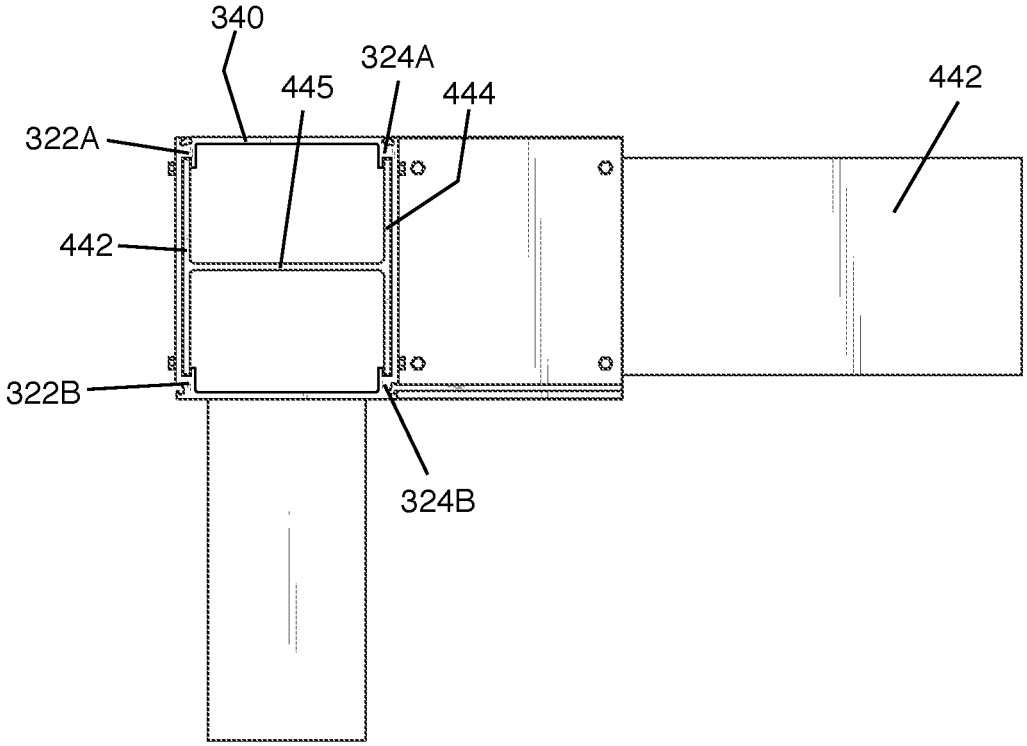
FIG. 21B is a side view of the beam support bracket illustrated in FIG. 21A.

Furthermore, with reference to FIGS. 21A and 21B, the body 340 of the beam support bracket may include an angled configuration. In the embodiment shown, the bracket exhibits a ninety degree angle, however, other angles are contemplated. Again, the bracket includes a plurality of at least two support members 400 each extending outwardly from a different end 340A, 340B.

Figure 22A:
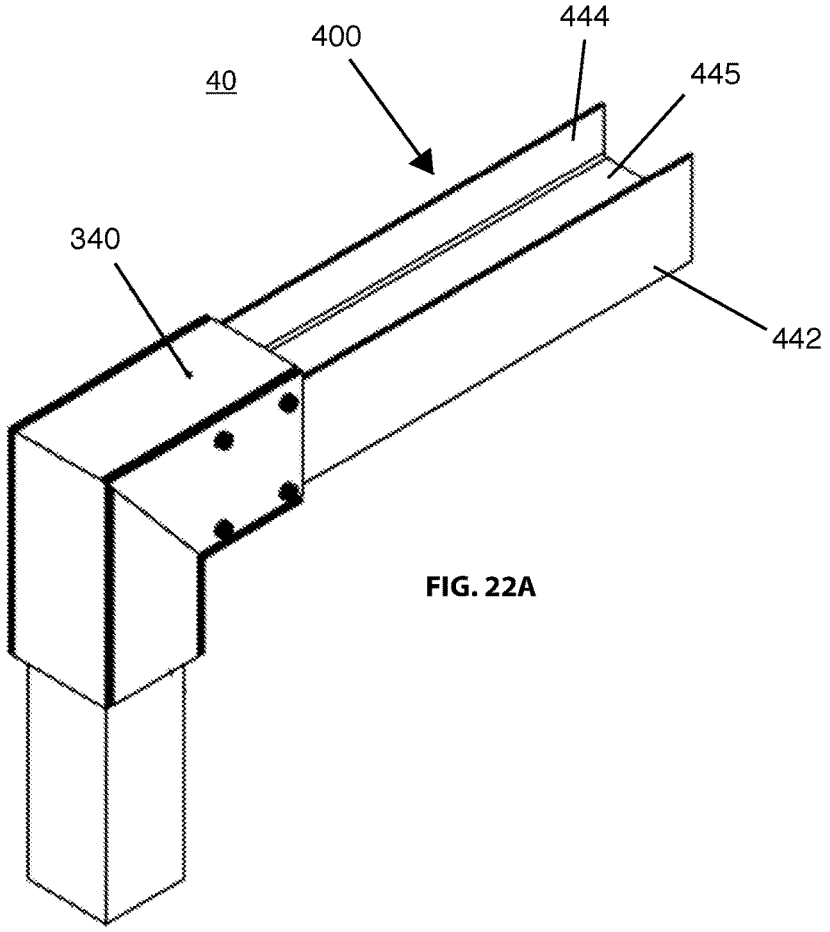
FIG. 22A is a perspective view of another beam support bracket as disclosed herein.
Figure 22B:
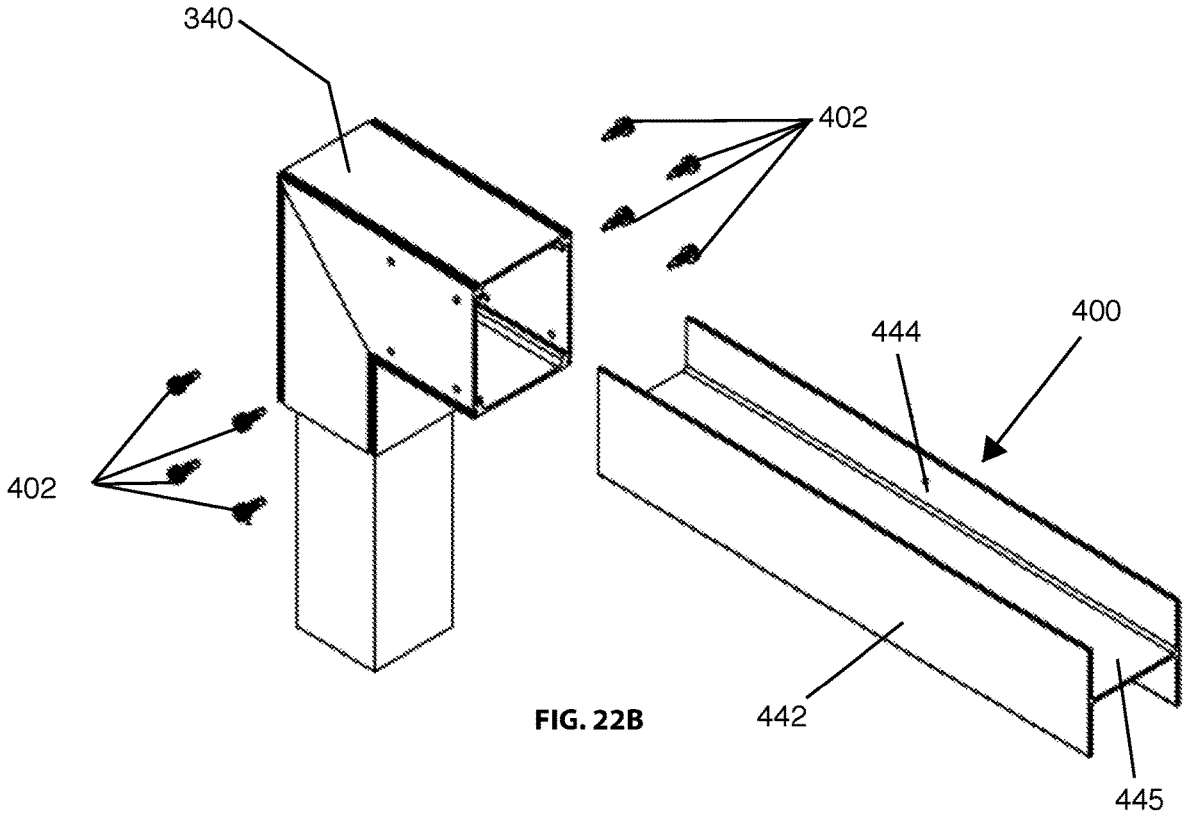
FIG. 22B is an exploded perspective view of the beam support bracket illustrated in FIG. 22A.

In addition, with reference to FIGS. 22A and 22B, the body 340 of the beam support bracket may include a single open end 340A within which the support member 400 is disposed. Downward extension 50 can be secured to a vertical support post 30 in the manner described in the various embodiments herein.

Figure 23:
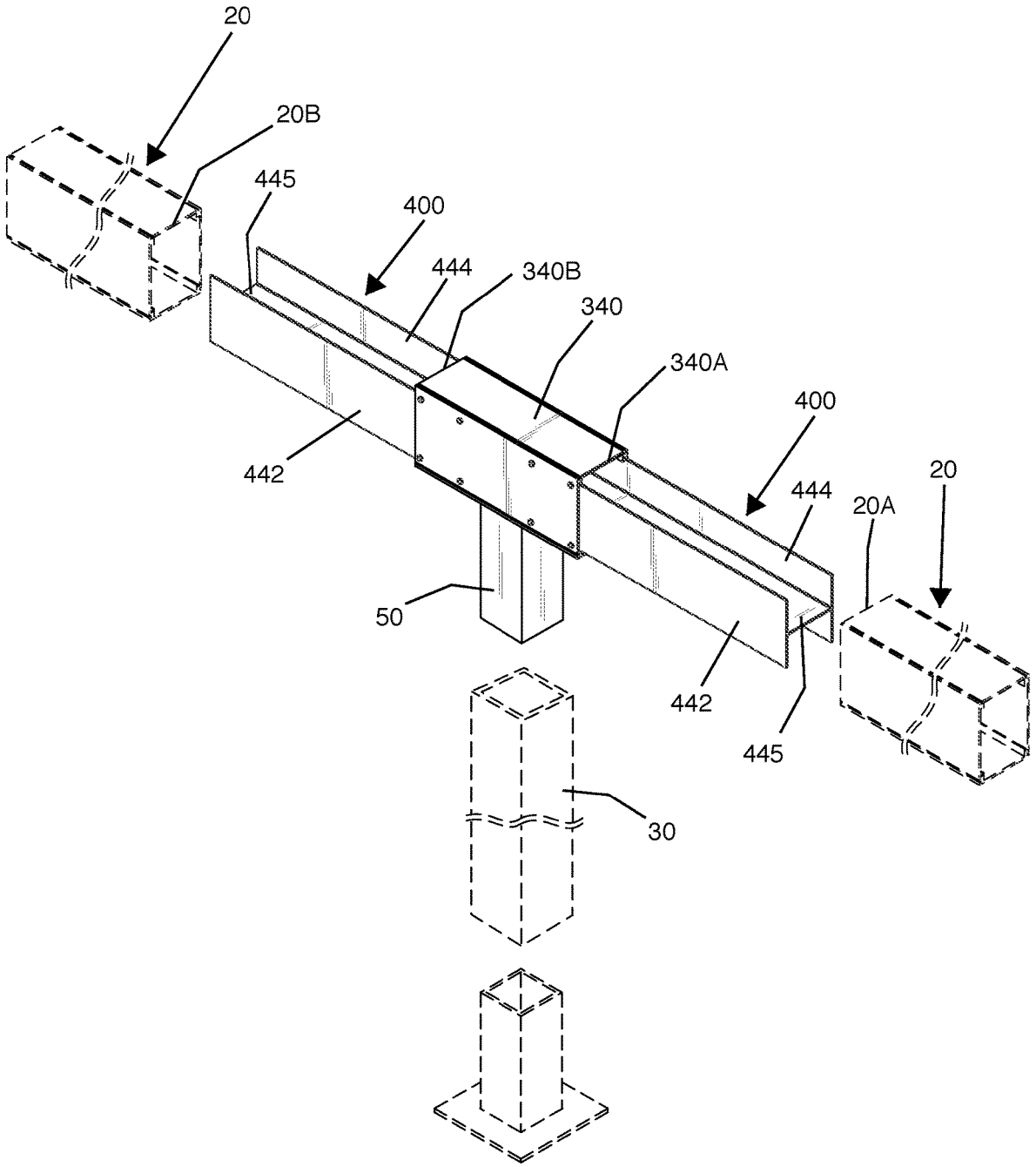
FIG. 23 is an exploded view of the support assembly as disclosed in accordance with at least one embodiment of the present invention.

With reference to the exploded view of FIG. 23, the beam support bracket 40 of at least one embodiment may engage with a support post 30 via downward portion 50. Support members 400 extending from the body 340 of the beam support bracket will slidingly engage lateral beam(s) 20, in the manner described herein, and as illustrated in FIGS. 16A and 16B. In this embodiment, a first end 340A of the body 340 will mate flush against a corresponding end 20A of a corresponding lateral beam 20, and a second end 340B of the body 340 will mate flush against a corresponding end 20B of a corresponding lateral beam 20.

Figure 24:
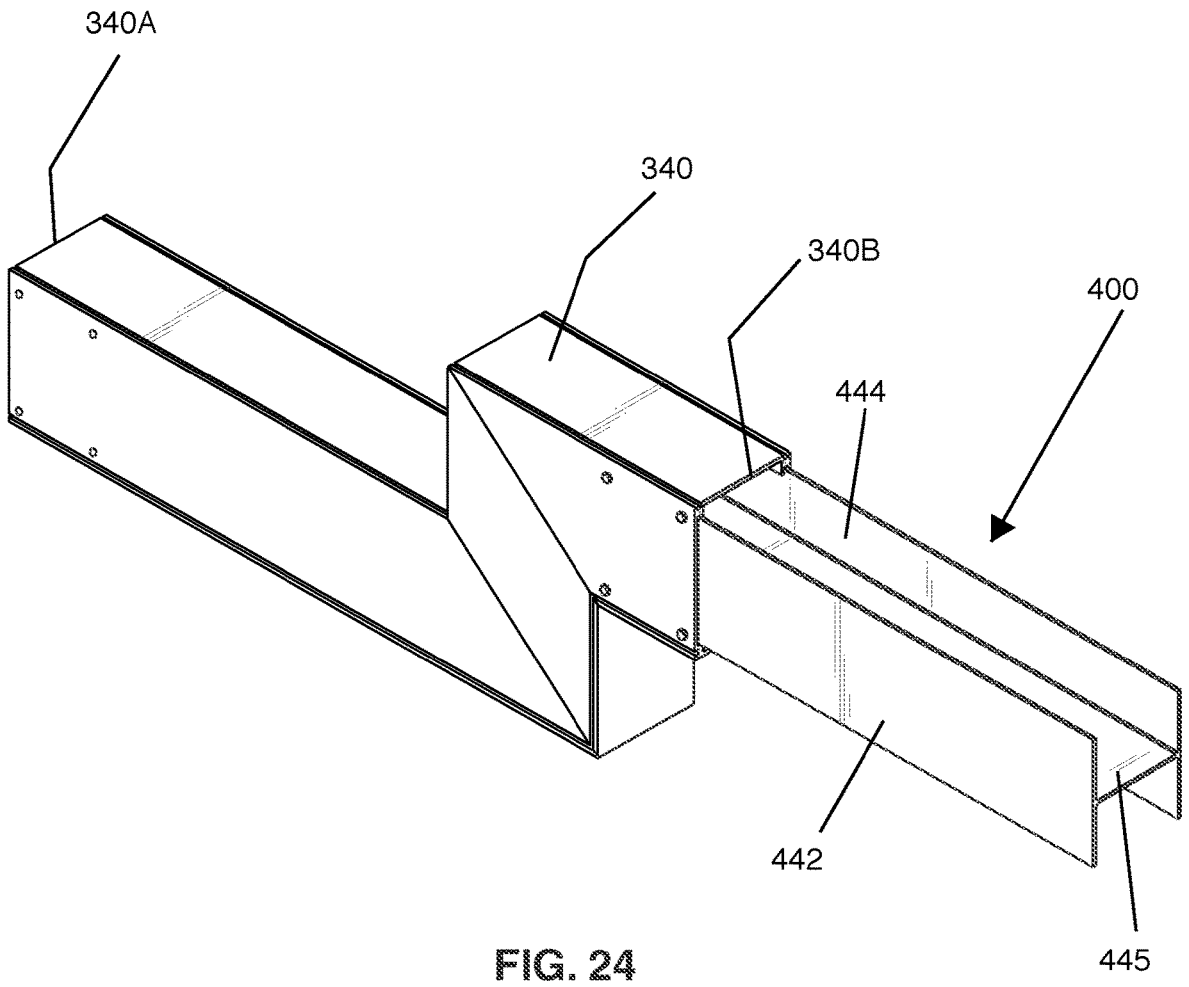
FIG. 24 is a perspective view of another beam support bracket as disclosed herein.
Figure 25:
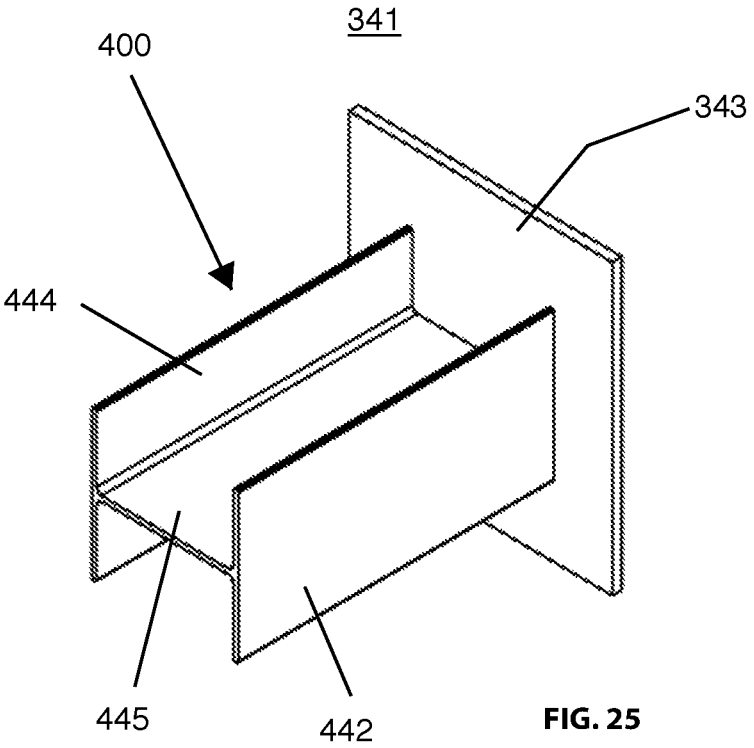
FIG. 25 is a perspective view of another beam support bracket as disclosed herein.

Referring now to FIGS. 24 and 25, yet another embodiment of the beam support bracket 340 is shown. Particularly, instead of being secured to a vertically oriented support post, the beam support bracket 340 illustrated in FIG. 24 may be secured to the structure 1, itself, such as a tie-beam, wall, post, pillar, etc., via a mounting bracket 341, shown in FIG. 25. For instance, the mounting bracket 341 of the beam support bracket 340 may include a base 343 secured to the structure 1, with a support member 400 extending from the base 343. The first end 340A of the body 340 may therefore slidingly engage with support member 400 extending from mounting bracket 341 shown in FIG. 25. A support member 400 extends outwardly from the second end 340B of the body 340, as shown in FIG. 24, which will then slidingly engage with the lateral beam 20, as provided herein.

Figure 26:
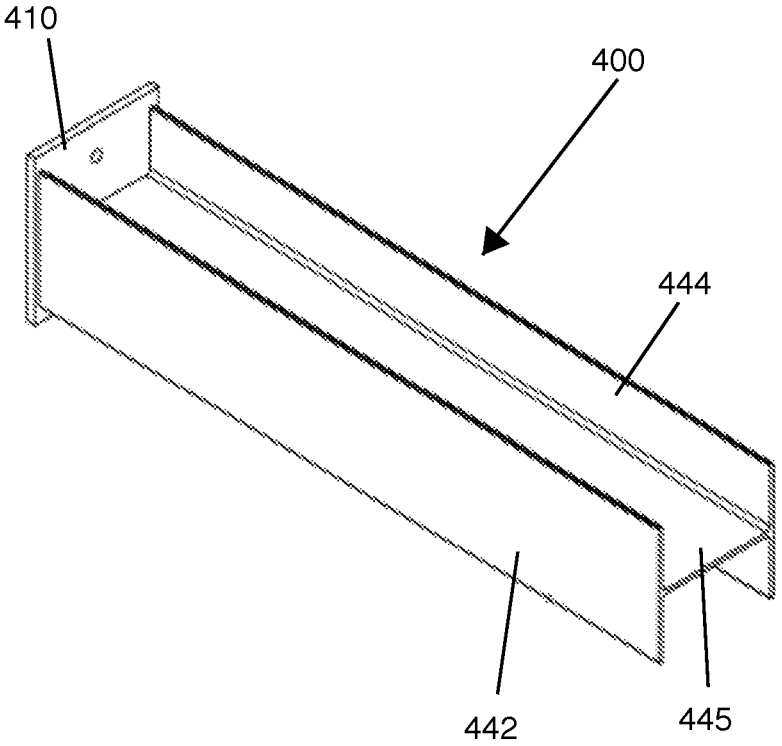
FIG. 26 is a perspective view of another beam support bracket as disclosed herein.

FIG. 26 illustrates yet another structure defined by bracket 410 and support member 400. In particular, support member 400 extends from bracket 410, while bracket 410 is secure along the vertical length of a support post 30, as shown in the exploded view of FIG. 27.

Figure 27:
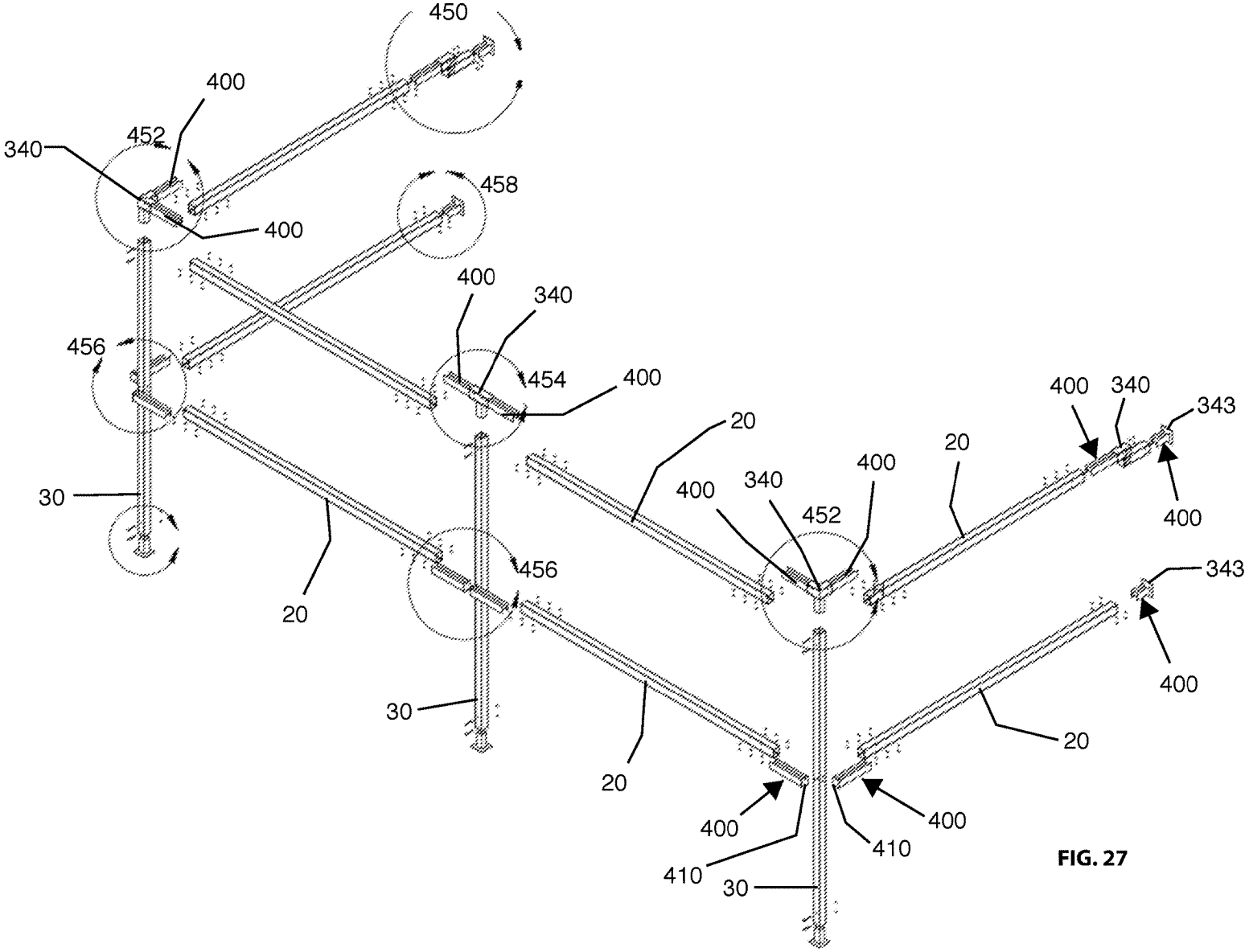
FIG. 27 is a perspective view of an exemplary support assembly as disclosed in accordance with at least one embodiment of the present invention.

Specifically, FIG. 27 illustrates an exemplary support assembly with a plurality of beam support brackets 340, lateral beams 20 and support posts 30, as described herein. Particularly, reference character 450 represents the beam support bracket and base as illustrated in FIGS. 25 and 25. Reference characters 452 refer to the beam support brackets illustrated in FIGS. 21A and 21B. Reference character 454 represents the beam support bracket illustrated in FIGS. 20A, 20B and 20C. Reference character refer to the bracket 410 and support member 400 illustrated in FIG. 26. Reference character 458 refers to the bracket illustrated in FIG. 25 interconnected directly to a lateral beam 20. It should be noted that the assembly illustrated in FIG. 27 is provided for exemplary purposes only to show the interconnection of the various pieces and brackets described herein.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described.

What is claimed is:

1. A support assembly, comprising:

a beam support bracket comprising a body and at least one support member extending outwardly from an end of said body, said at least one support member comprising at least two elongated extension members interconnected to one another via an intermediate connecting member, said body of said beam support bracket comprising an internal receiving portion, a first surface protrusion pair disposed within said internal receiving portion of said body and a second surface protrusion pair disposed within said internal receiving portion of said body, wherein a first one of said at least two elongated extension members is disposed at least partially between said first surface protrusion pair of said body of said beam support bracket, and a second one of said at least two elongated extension members is disposed at least partially between said second protrusion pair of said body of said beam support bracket, a lateral beam slidingly engaged with at least a portion of said at least one support member extending outwardly from said end of said body, said lateral beam comprising an internal receiving portion, a first surface protrusion pair disposed within said internal receiving portion of said lateral beam and a second surface protrusion pair disposed within said internal receiving portion of said lateral beam, and wherein said first one of said at least two elongated extension members is disposed at least partially between said first surface protrusion pair of said lateral beam, and said second one of said at least two elongated extension members is disposed at least partially between said second protrusion pair of said lateral beam.

2. The support assembly as recited in claim 1 wherein said end of said body of said beam support bracket mates against an end of said lateral beam while a portion of said at least two elongated extension members of said at least one support member is disposed within said body and while another portion of said at least two elongated extension members of said at least one support member is disposed within said lateral beam.

3. The support assembly as recited in claim 1 wherein said first surface protrusion pair of said body of said beam support bracket is defined by two surface protrusions, wherein each of said two surface protrusions of said first surface protrusion pair comprise an extended lip at least partially defining a first receiving channel.

4. The support assembly as recited in claim 3 wherein said second surface protrusion pair of said body of said beam support bracket is defined by two surface protrusions, wherein each of said two surface protrusions of said second surface protrusion pair of said body of said beam support bracket comprise an extended lip at least partially defining a second receiving channel.

5. The support assembly as recited in claim 4 wherein said two surface protrusions of said first surface protrusion pair of said body of said beam support bracket are disposed within two adjacent inner corners of said internal receiving portion of said body of said beam support bracket.

6. The support assembly as recited in claim 5 wherein said two surface protrusions of said second surface protrusion pair are disposed within two other adjacent inner corners of said internal receiving portion of said body of said beam support bracket.

7. The support assembly as recited in claim 6 wherein said at least one support member is fixedly secured to said body of said beam support bracket.

8. The support assembly as recited in claim 1 wherein said beam support bracket comprises two support members, wherein a first one of said two support members extends outwardly from said end of said body and wherein a second one of said two support members extends outwardly from a second end of said body.

9. The support assembly as recited in claim 8 wherein another lateral beam is slidingly engaged with said second one of said two support members.

10. The support assembly as recited in claim 1 wherein said body of said beam support bracket and said lateral beam comprise substantially similar construction with different lengths.

11. The support assembly as recited in claim 1 wherein said body of said beam support bracket comprises a cross section having a substantially similar construction as a cross section of said lateral beam.

12. A support assembly, comprising:

a beam support bracket, said beam support bracket comprising a body defining a first end, a second end, and an internal receiving portion, said body of said beam support bracket further comprising a first surface protrusion pair and a second surface protrusion pair each disposed within said internal receiving portion of said body, wherein said first surface protrusion pair of said body of said beam support bracket is defined by two surface protrusions, each of said two surface protrusions of said first surface protrusion pair comprise an extended lip at least partially defining a first receiving channel, wherein said second surface protrusion pair of said body of said beam support bracket is defined by two surface protrusions, wherein each of said two surface protrusions of said second surface protrusion pair of said body of said beam support bracket comprise an extended lip at least partially defining a second receiving channel, a first support member extending outwardly from said first end of said body, a second support member extending outwardly from said second end of said body, said first support member comprising two elongated extension members interconnected to one another via a connecting member, said second support member comprising two elongated extension members interconnected to one another via a connecting member, wherein a first one of said two elongated extension members of said first support member is disposed between said first surface protrusion pair at said first end of said body, and a second one of said at least two elongated extension members of said first support member is disposed between said second surface protrusion pair at said first end of said body, and wherein a first one of said two elongated extension members of said second support member is disposed between said first surface protrusion pair at said second end of said body, and a second one of said at least two elongated extension members of said second support member is disposed between said second surface protrusion pair at said second end of said body.

13. The support assembly as recited in claim 12 further comprising a first lateral beam slidingly engaged with at least a portion of said first support member, wherein an end of said first lateral beam mates with said first end of said body of said beam support bracket.

14. The support assembly as recited in claim 13 further comprising a second lateral beam slidingly engaged with at least a portion of said second support member, wherein and end of said second lateral beam mates with said second end of said body of said beam support bracket.

15. The support assembly as recited in claim 14 wherein said body of said beam support bracket comprises a cross section having a substantially similar construction as a cross section of said first lateral beam and a cross section of said second lateral beam.

16. The support assembly as recited in claim 14 wherein said first support member and said second support member are I-beams.

17. A support assembly, comprising:

a beam support bracket comprising a body and at least one support member extending outwardly from an end of said body, said beam support bracket comprising a body defining a first end and a second end, said body of said beam support bracket further comprising a first surface protrusion pair and a second surface protrusion pair each disposed within an internal receiving portion of said body, said beam support bracket further comprising a first support member fixed to said body and extending from said first end of said body, wherein said first support member is an I-beam defined as comprising two parallel elongated extension members interconnected via a connecting member, said beam support bracket further comprising a second support member fixed to said body and extending from said second end of said body, wherein said second support member is an I-beam defined as comprising two parallel elongated extension members interconnected via a connecting member, a first lateral beam slidingly engaged with a portion of said first support member, and a second lateral beam slidingly engaged with a portion of said second support member.

18. The support assembly as recited in claim 17 wherein a first one of said two parallel elongated extension members of said first support member is disposed between said first surface protrusion pair at said first end of said body, and a second one of said at least two parallel elongated extension members of said first support member is disposed between said second surface protrusion pair at said first end of said body, and wherein a first one of said two parallel elongated extension members of said second support member is disposed between said first surface protrusion pair at said second end of said body, and a second one of said at least two parallel elongated extension members of said second support member is disposed between said second surface protrusion pair at said second end of said body.

* * * * *